US007369671B2

(12) United States Patent
Sacha et al.

(10) Patent No.: US 7,369,671 B2
(45) Date of Patent: May 6, 2008

(54) SWITCHING STRUCTURES FOR HEARING AID

(75) Inventors: Mike K. Sacha, Chanhassen, MN (US); Mark A. Bren, Loretto, MN (US); Timothy S. Peterson, Lino Lakes, MN (US); Randall W. Roberts, Eden Prairie, MN (US)

(73) Assignee: Starkey, Laboratories, Inc., Eden Prairie, MN (US)

( * ) Notice: Subject to any disclaimer, the term of this patent is extended or adjusted under 35 U.S.C. 154(b) by 325 days.

(21) Appl. No.: 10/244,295

(22) Filed: Sep. 16, 2002

(65) Prior Publication Data

US 2004/0052392 A1 Mar. 18, 2004

(51) Int. Cl.
*H04R 25/00* (2006.01)

(52) U.S. Cl. ..... 381/331; 381/312; 381/327; 381/328

(58) Field of Classification Search ..... 381/312, 381/324, 327–328, 331
See application file for complete search history.

(56) References Cited

U.S. PATENT DOCUMENTS

| | | | | |
|---|---|---|---|---|
| 2,530,621 A | | 11/1950 | Lybarger | 179/107 |
| 2,554,834 A | | 5/1951 | Lavery | 179/107 |
| 2,656,421 A | | 10/1953 | Lybarger | 179/107 |
| 3,396,245 A | | 8/1968 | Flygstad | 179/107 |
| 3,660,695 A | | 5/1972 | Schmitt | 307/309 |
| 4,187,413 A | | 2/1980 | Moser | 179/107 |
| 4,467,145 A | * | 8/1984 | Borstel | 381/329 |
| 4,489,330 A | | 12/1984 | Marutake et al. | 343/742 |
| 4,490,585 A | | 12/1984 | Tanaka | 179/107 |
| 4,508,940 A | | 4/1985 | Steeger | 179/107 |
| 4,596,899 A | | 6/1986 | Wojcik et al. | |
| 4,631,419 A | | 12/1986 | Sadamatsu et al. | 307/255 |
| 4,638,125 A | | 1/1987 | Buettner | 381/68.4 |
| 4,696,032 A | | 9/1987 | Levy | 379/390 |
| 4,710,961 A | | 12/1987 | Buttner | 381/68.7 |
| 4,756,312 A | * | 7/1988 | Epley | 607/57 |

(Continued)

FOREIGN PATENT DOCUMENTS

| | | |
|---|---|---|
| CH | 670349 | 5/1989 |

(Continued)

OTHER PUBLICATIONS

Beck, L..B. , "The "T" Switch; Some Tips for Effective Use", *Shhh*, (Jan./Feb. 1989),pp. 12-15.

(Continued)

*Primary Examiner*—Curtis Kuntz
*Assistant Examiner*—Phylesha L Dabney
(74) *Attorney, Agent, or Firm*—Schwegman, Lundberg & Woessner, P.A.

(57) ABSTRACT

A hearing aid is provided with a a programmable, signal processing circuit electrically connecting an input system to an output system, a magnetic field sensor, and a selection circuit connected to the magnetic sensor. The selection circuit may be adapted to control at least one of the input system, output system, and the signal processing circuit, where the selection circuit in conjunction with the magnetic field is configured to select the system or circuit to control based a magnetic field strength received at the magnetic field sensor being one of at least three levels of magnetic field strength.

29 Claims, 12 Drawing Sheets

U.S. PATENT DOCUMENTS

| | | | | |
|---|---|---|---|---|
| 4,764,957 | A | 8/1988 | Angelini et al. | 379/433 |
| 4,845,755 | A | 7/1989 | Busch et al. | 381/68 |
| 4,862,509 | A | 8/1989 | Towsend | 381/163 |
| 4,887,299 | A | 12/1989 | Cummins et al. | 381/68.4 |
| 4,926,464 | A | 5/1990 | Schley-May | 379/99 |
| 4,930,156 | A | 5/1990 | Norris | 379/388 |
| 5,010,575 | A | 4/1991 | Marutake et al. | 381/68 |
| 5,027,410 | A | 6/1991 | Williamson et al. | |
| 5,086,464 | A | 2/1992 | Groppe | 379/430 |
| 5,091,952 | A | 2/1992 | Williamson et al. | |
| 5,189,704 | A | 2/1993 | Krauss | 381/68.4 |
| 5,212,827 | A | 5/1993 | Meszko et al. | 455/225 |
| 5,280,524 | A | 1/1994 | Norris | 379/387 |
| 5,404,407 | A | 4/1995 | Weiss | 381/68 |
| 5,422,628 | A | 6/1995 | Rodgers | 340/573 |
| 5,425,104 | A | 6/1995 | Shennib | 381/68 |
| 5,463,692 | A | 10/1995 | Fackler | 381/68 |
| 5,524,056 | A | 6/1996 | Killion et al. | 381/68.2 |
| 5,553,152 | A * | 9/1996 | Newton | 381/328 |
| 5,600,728 | A | 2/1997 | Satre | |
| 5,629,985 | A | 5/1997 | Thompson | |
| 5,636,285 | A | 6/1997 | Sauer | 381/68.2 |
| 5,640,293 | A | 6/1997 | Dawes et al. | 361/93 |
| 5,640,457 | A | 6/1997 | Gnecco et al. | |
| 5,659,621 | A | 8/1997 | Newton | 381/68 |
| 5,687,242 | A | 11/1997 | Iburg | |
| 5,706,351 | A | 1/1998 | Weinfurtner | 381/68.2 |
| 5,710,820 | A | 1/1998 | Martin et al. | 381/68.4 |
| 5,721,783 | A | 2/1998 | Anderson | |
| 5,737,430 | A | 4/1998 | Widrow | |
| 5,740,257 | A | 4/1998 | Marcus | |
| 5,751,820 | A | 5/1998 | Taenzer | 381/68 |
| 5,757,932 | A | 5/1998 | Lindemann et al. | |
| 5,757,933 | A | 5/1998 | Preves et al. | 381/68 |
| 5,768,397 | A | 6/1998 | Fazio | 381/68 |
| 5,796,848 | A | 8/1998 | Martin | 381/68.2 |
| 5,809,151 | A | 9/1998 | Husung | 381/69 |
| 5,823,610 | A | 10/1998 | Ryan et al. | 296/180.4 |
| 5,991,419 | A | 11/1999 | Brander | |
| 5,991,420 | A | 11/1999 | Stern | 381/315 |
| 6,031,922 | A | 2/2000 | Tibbetts | |
| 6,031,923 | A | 2/2000 | Gnecco et al. | |
| 6,078,675 | A | 6/2000 | Bowen-Nielsen et al. | 381/331 |
| 6,101,258 | A | 8/2000 | Killion et al. | |
| 6,104,821 | A | 8/2000 | Husung | 381/312 |
| 6,115,478 | A | 9/2000 | Schneider | 381/314 |
| 6,118,877 | A | 9/2000 | Lindemann et al. | 381/60 |
| 6,148,087 | A | 11/2000 | Martin | 381/327 |
| 6,157,727 | A | 12/2000 | Rueda | 381/312 |
| 6,157,728 | A | 12/2000 | Tong et al. | |
| 6,175,633 | B1 | 1/2001 | Morrill et al. | |
| 6,240,194 | B1 | 5/2001 | De Koning | |
| 6,310,556 | B1 | 10/2001 | Green et al. | 340/636 |
| 6,324,291 | B1 | 11/2001 | Weidner | 381/322 |
| 6,327,370 | B1 | 12/2001 | Killion et al. | |
| 6,356,741 | B1 | 3/2002 | Bilotti et al. | 455/90 |
| 6,381,308 | B1 | 4/2002 | Cargo et al. | 379/52 |
| 6,459,882 | B1 | 10/2002 | Palermo et al. | 455/41 |
| 6,466,679 | B1 | 10/2002 | Husung | 381/324 |
| 6,549,633 | B1 | 4/2003 | Westermann | |
| 6,633,645 | B2 | 10/2003 | Bren et al. | |
| 6,760,457 | B1 | 7/2004 | Bren et al. | |
| 7,016,511 | B1 * | 3/2006 | Shennib | 381/315 |
| 2003/0059073 | A1 | 3/2003 | Bren et al. | |
| 2004/0052391 | A1 | 3/2004 | Bren et al. | |
| 2006/0013420 | A1 | 1/2006 | Sacha | |

FOREIGN PATENT DOCUMENTS

| | | |
|---|---|---|
| DE | 2510731 | 9/1976 |
| DE | 3036417 | 5/1982 |
| DE | 3443907 | 6/1985 |
| EP | 1133236 | 10/1966 |
| EP | 0031152 A2 | 7/1981 |
| EP | 1196008 A2 | 4/2002 |
| EP | 1174003 B1 | 7/2004 |
| FR | 2714561 | 6/1995 |
| GB | 1254018 | 11/1971 |
| JP | 09-018998 | 1/1997 |

OTHER PUBLICATIONS

Gilmore, R.., "Telecoils: past, present & future", *Hearing Instruments, 44* (2), (1993),pp. 22, 26-27, 40.

Lybarger, S..F. , "Development of a New Hearing Aid with Magnetic Microphone", *Electrical Manufacturing*, (Nov. 1947), 11 pages.

Preves, D..A. , "A Look at the Telecoil—It's Development and Potential", *SHHH Journal*, (Sep./Oct. 1994),pp. 7-10.

Hansaton Akustik GMBH, "48 K-AMP Contactmatic", (*from Service Manual*), (Apr. 1996),8 pgs.

Schaefer, Conrad , "Letter referencing Micro Ear Patent", (Aug. 22, 2002),2 pgs.

"Partial European Search Report for corresponding EP Application No. 03255764", (Apr. 13, 2007), 4 pgs.

Lacanette, K., "A Basic Introduction to Filters—Active, Passive, and Switched-Capacitor", *National Semiconductor Corporation*, http://www.swarthmore.edu/NatSci/echeeve1/Ref/DataSheet/Inttofilters.pdf,(Apr. 1991).

* cited by examiner

SWITCHING STRUCTURES FOR HEARING AID

RELATED APPLICATIONS

The present application is generally related to U.S. application Ser. No. 09/659,214, filed Sep. 11, 2000, now U.S. Pat. No. 6,760,457, and titled AUTOMATIC SWITCH FOR HEARTNG AID, which is hereby incorporated by reference.

The present application is generally related to U.S. application Ser. No. 10/243,412, filed Sep. 12, 2002, and titled SYSTEM AND METHOD FOR SELECTIVELY COUPLING HEARING AIDS TO ELECTROMAGNETIC SIGNALS, which is hereby incorporated by reference.

FIELD OF THE INVENTION

This invention relates generally to hearing aids, and more particularly to switching structures and systems for a hearing aid.

BACKGROUND

Hearing aids can provide adjustable operational modes or characteristics that improve the performance of the hearing aid for a specific person or in a specific environment. Some of the operational characteristics are volume control, tone control, and selective signal input. One way to control these characteristics is by a manually engagable switch on the hearing aid. The hearing aid may include both a non-directional microphone and a directional microphone in a single hearing aid. Thus, when a person is talking to someone in a crowded room the hearing aid can be switched to the directional microphone in an attempt to directionally focus the reception of the hearing aid and prevent amplification of unwanted sounds from the surrounding environment. However, a conventional switch on the hearing aid is a switch that must be operated by hand. It can be a drawback to require manual or mechanical operation of a switch to change the input or operational characteristics of a hearing aid. Moreover, manually engaging a switch in a hearing aid that is mounted within the ear canal is difficult, and may be impossible, for people with impaired finger dexterity.

In some known hearing aids, magnetically activated switches are controlled through the use of magnetic actuators. For examples, see U.S. Pat. Nos. 5,553,152 and 5,659,621. The magnetic actuator is held adjacent the hearing aid and the magnetic switch changes the volume. However, such a hearing aid requires that a person have the magnetic actuator available when it desired to change the volume. Consequently, a person must carry an additional piece of equipment to control his/her hearing aid. Moreover, there are instances where a person may not have the magnetic actuator immediately present, for example, when in the yard or around the house.

Once the actuator is located and placed adjacent the hearing aid, this type of circuitry for changing the volume must cycle through the volume to arrive at the desired setting. Such an action takes time and adequate time may not be available to cycle through the settings to arrive at the required setting, for example, there may be insufficient time to arrive at the required volume when answering a telephone.

Some hearing aids have an input which receives the electromagnetic voice signal directly from the voice coil of a telephone instead of receiving the acoustic signal emanating from the telephone speaker. Accordingly, signal conversion steps, namely, from electromagnetic to acoustic and acoustic back to electromagnetic, are removed and a higher quality voice signal reproduction may be transmitted to the person wearing the hearing aid. It may be desirable to quickly switch the hearing aid from a microphone (acoustic) input to a coil (electromagnetic field) input when answering and talking on a telephone. However, quickly manually switching the input of the hearing aid from a microphone to a voice coil, by a manual mechanical switch or by a magnetic actuator, may be difficult for some hearing aid wearers.

SUMMARY OF THE INVENTION

Upon reading and understanding the present disclosure it is recognized that the inventive subject matter described herein satisfies the foregoing needs in the art and several other needs in the art not expressly noted herein. The following summary is provided to give the reader a brief summary which is not intended to be exhaustive or limiting and the scope of the invention is provided by the attached claims and the equivalents thereof.

One embodiment of the present invention provides a hearing aid that includes an input system, an output system, a signal processing circuit electrically connecting the input system to the output system, a magnetically actuatable switch between the input system and the signal processing circuit, and a filter connected to and controlled by the magnetically-actuatable switch. The switch allows the filter to filter a signal from the input system to the signal processing circuit or prevents the filter from filtering the signal. In an embodiment, the switch is a solid state switch. In an embodiment, the solid state switch is a giant magneto resistive (GMR) switch. In an embodiment, the solid state switch is an anisotropic magneto resistive (AMR) switch. In an embodiment, the solid state switch is a magnetic field effect transistor.

In an embodiment of the present invention, a magnetically actuatable switch is positioned between the output system and the signal processing circuit. This switch controls operation of a device before the output system or at the output system. In an embodiment, the switch selectively connects an output filter that filters the signal received by the output system. In an embodiment, the hearing aid includes a plurality of filters that are selectable based on the magnetic field sensed by the magnet switch or a magnetic field sensor.

An embodiment of the present invention provides a hearing aid that includes an input system, an output system, a programmable, signal processing circuit electrically connecting the input system to the output system, a magnetic field sensor, and a selection circuit connected to the magnetic sensor and at least one of the input system, output system and the signal processing system. The selection circuit is adapted to control the at least one of the input system, output system and the signal processing system based on a signal produced by the magnetic field sensor. The selection circuit is adapted to receive an electrical signal from the magnetic sensor and supply a programming signal to the signal processing circuit. In an embodiment, the magnetic field sensor is a full bridge circuit. In an embodiment, the magnetic field sensor is adapted to receive a pulsed power supply. In an embodiment, the selection circuit is connected to the input system and sends a control signal to the input system based on a signal received from the magnetic field sensor. In an embodiment, the input system includes a first input and a second input, and the input system activates one of the first input and the second input based on the control signal. The first input includes a microphone. The second input includes a magnetic field sensing device. The hearing aid of the present invention further includes a threshold circuit that blocks signals below a threshold value.

An embodiment of the present invention provides a hearing aid that includes a programming system that is adapted to sense a magnetic field and based on the magnetic field produce a programming signal. The programming signal, in an embodiment, includes a control sequence or code that allows the hearing aid to be programmed. The programming signal further includes a digital programming signal based on the magnetic field sensed by a magnetic field sensor.

An embodiment of the present invention includes a wireless on/off switch. The wireless on/off switch includes a magnetically operable switch. In an embodiment, the magnetically operable switch is a solid state switch. The on/off switch turns off the non-essential power to the hearing aid circuits to preserve battery power. In an embodiment, a system is provided that stores the hearing aid and provides a signal to turn off the hearing aid.

An embodiment of the invention includes a wireless switch that activates a power induction circuit in the hearing aid. The power induction circuit is adapted to receive a recharging signal from a power source and recharge the hearing aid power source. In an embodiment, the wireless switch that activates the power induction circuit also turns off the non-essential power consuming circuits of the hearing aid.

An embodiment of the invention includes a system that has a magnetic field source. In an embodiment, the magnetic field source being adapted to program the hearing aid. In an embodiment, the magnetic field source is adapted to wirelessly turn off and turn on the hearing aid. The system includes a storage receptacle for the hearing aid. In an embodiment, the magnetic field source provides a power induction signal that is adapted to recharge the hearing aid power source.

Further embodiments of the present invention will be understood from reading the present disclosure.

BRIEF DESCRIPTION OF THE DRAWINGS

A more complete understanding of the invention and its various features, objects and advantages may be obtained from a consideration of the following detailed description, the appended claims, and the attached drawings in which:

DETAILED DESCRIPTION

In the following detailed description, reference is made to the accompanying drawings which form a part hereof and in which are shown by way of illustration specific embodiments in which the invention can be practiced. These embodiments are described in sufficient detail to enable those skilled in the art to practice and use the invention, and it is to be understood that other embodiments may be utilized and that electrical, logical, and structural changes may be made without departing from the spirit and scope of the present invention. The following detailed description is, therefore, not to be taken in a limiting sense and the scope of the present invention is defined by the appended claims and their equivalents.

Hearing aids provide different hearing assistance functions including, but not limited to, directional and non-directional inputs, multi-source inputs, filtering and multiple output settings. Hearing aids are also provide user specific and/or left or right ear specific functions such as frequency response, volume, varying inputs and signal processing. Accordingly, a hearing aid is programmable with respect to these functions or switch between functions based on the operating environment and the user's hearing assistance needs. A hearing aid is described that includes magnetically operated switches and programming structures.

Figure 1:
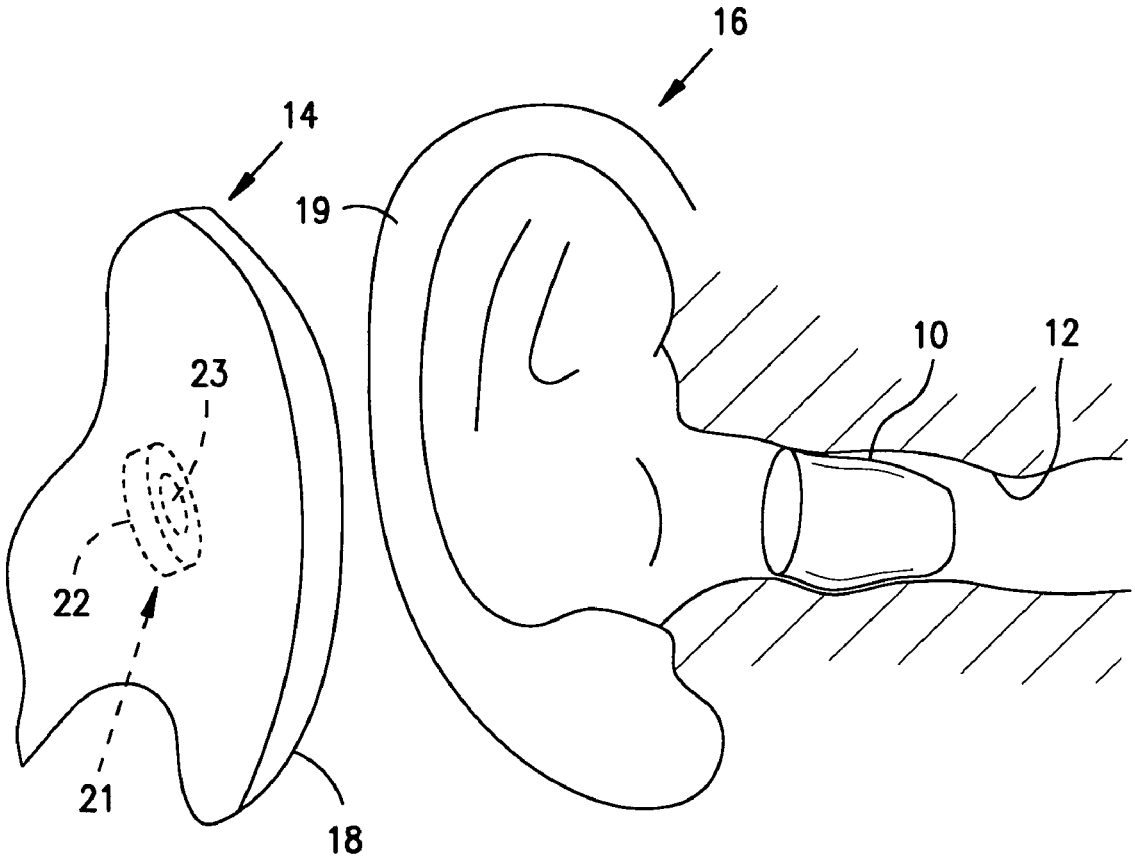
FIG. 1 illustrates the hearing aid of the present invention adjacent a magnetic field source.

FIG. 1 illustrates an in-the-ear hearing aid 10 that is positioned completely in the ear canal 12. A telephone handset 14 is positioned adjacent the ear 16 and, more particularly, the speaker 18 of the handset is adjacent the pinna 19 of ear 16. Speaker 18 includes an electromagnetic transducer 21 which includes a permanent magnet 22 and a voice coil 23 fixed to a speaker cone (not shown). Briefly, the voice coil 23 receives the time-varying component of the electrical voice signal and moves relative to the stationary magnet 22. The speaker cone moves with coil 23 and creates an audio pressure wave ("acoustic signal"). It has been found that when a person wearing a hearing aid uses a telephone it is more efficient for the hearing aid 10 to pick up the voice signal from the magnetic field gradient produced by the voice coil 23 and not the acoustic signal produced by the speaker cone.

Figure 2:
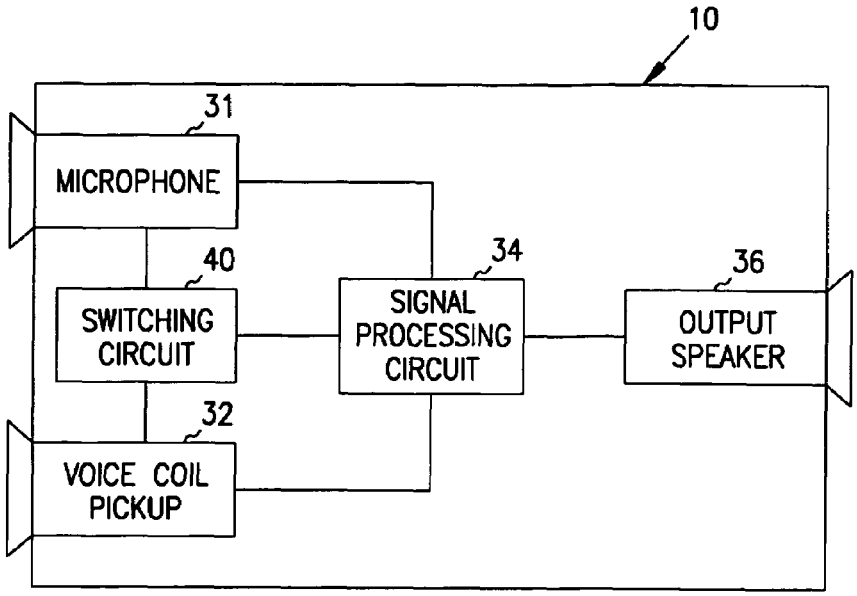
FIG. 2 is a schematic view of the FIG. 1 hearing aid.

Hearing aid 10 has two inputs, a microphone 31 and a voice coil pickup 32 (FIG. 2). The microphone 31 receives acoustic signals, converts them into electrical signals and transmits same to a signal processing circuit 34. The signal processing circuit 34 provides various signal processing functions which can include noise reduction, amplification, and tone control. The signal processing circuit 34 outputs an electrical signal to an output speaker 36 which transmits audio into the wearer's ear. The voice coil pickup 32 is an electromagnetic transducer, which senses the magnetic field gradient produced by movement of the telephone voice coil 23 and in turn produces a corresponding electrical signal which is transmitted to the signal processing circuit 34. Accordingly, use of the voice coil pickup 32 eliminates two of the signal conversions normally necessary when a conventional hearing aid is used with a telephone, namely, the telephone handset 14 producing an acoustic signal and the hearing aid microphone 31 converting the acoustic signal to an electrical signal. It is believed that the elimination of these signal conversions improves the sound quality that a user will hear from the hearing aid.

A switching circuit 40 is provided to switch the hearing aid input from the microphone 31, the default state, to the voice coil pickup 32, the magnetic field sensing state. It is desired to automatically switch the states of the hearing aid 10 when the telephone handset 14 is adjacent the hearing aid wearer's ear. Thereby, the need for the wearer to manually switch the input state of the hearing aid when answering a telephone call and after the call is ends. Finding and changing the state of the switch on a miniaturized hearing aid can be difficult especially when the wearer is under the time constraints of a ringing telephone or if the hearing aid is an in the ear type hearing aid.

Figure 3:
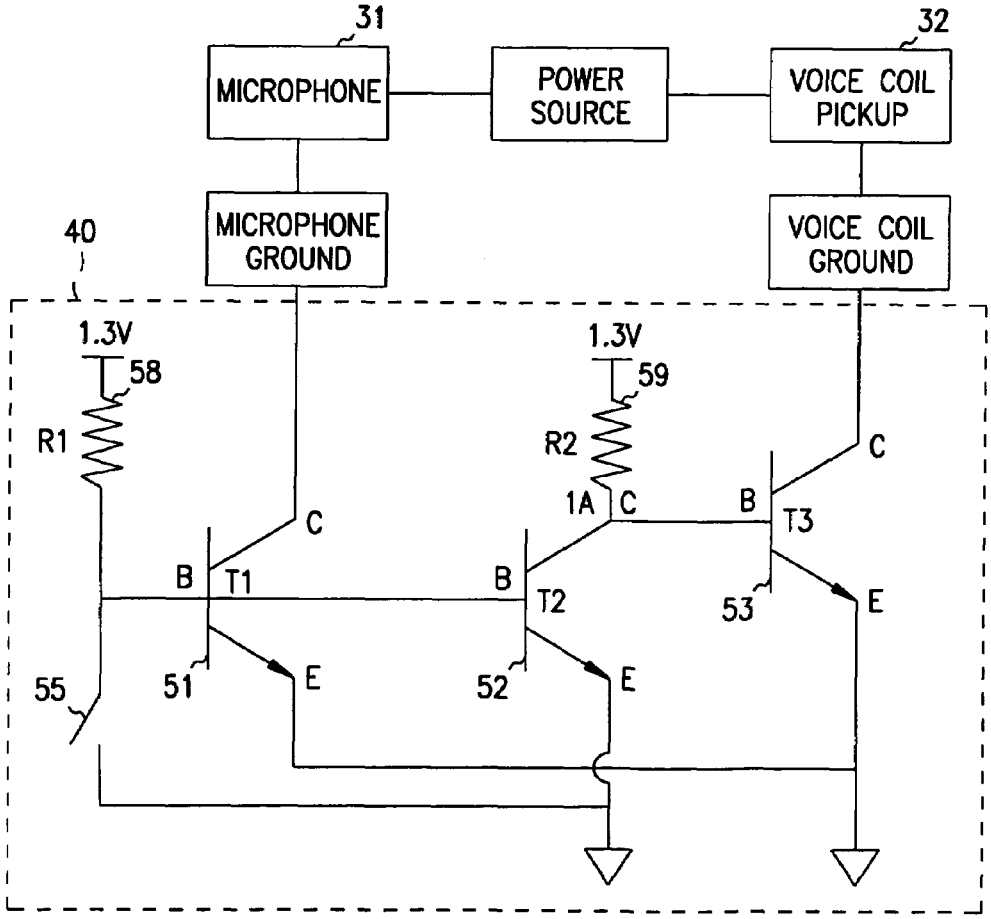
FIG. 3 shows a diagram of the switching circuit of FIG. 2.

The switching circuit 40 of the described embodiment changes state when in the presence of the telephone handset magnet 22, which produces a constant magnetic field that switches the hearing aid input from the microphone 31 to the voice coil pickup 32. As shown in FIG. 3, the switching circuit 40 includes a microphone activating first switch 51, here shown as a transistor that has its collector connected to the microphone ground, base connected to a hearing aid voltage source through a resistor 58, and emitter connected to ground. Thus, the default state of hearing aid 10 is switch 58 being on and the microphone circuit being complete. A second switch 52 is also shown as a transistor that has its collector connected to the hearing aid voltage source through a resistor 59, base connected to the hearing aid voltage source through resistor 58, and emitter connected to ground. A voice coil activating third switch 53 is also shown as a transistor that has its collector connected to the voice pick up ground, base connected to the collector of switch 52 and through resistor 59 to the hearing aid voltage source, and emitter connected to ground. A magnetically activated fourth switch 55 has one contact connected to the base of first switch 51 and through resistor 58 to the hearing aid voltage source, and the other contact is connected to ground. Contacts of switch 55 are normally open.

In this default open state of switch 55, switches 51 and 52 are conducting. Therefore, switch 51 completes the circuit connecting microphone 31 to the signal processing circuit 34. Switch 52 connects resistor 59 to ground and draws the voltage away from the base of switch 53 so that switch 53 is open and not conducting. Accordingly, hearing aid 10 is operating with microphone 31 active and the voice coil pickup 32 inactive.

Switch 55 is closed in the presence of a magnetic field, particularly in the presence of the magnetic field produced by telephone handset magnet 22. In one embodiment of the invention, switch 55 is a reed switch, for example a micro-miniature reed switch, type HSR-003 manufactured by Hermetic Switch, Inc. of Chickasha, Okla. In a further embodiment of the invention, the switch 55 is a solid state, wirelessly operable switch. In an embodiment, wirelessly refers to a magnetic signal. An embodiment of a magnetic signal operable switch is a MAGFET. The MAGFET is non-conducting in a magnetic field that is not strong enough to turn on the device and is conducting in a magnetic field of sufficient strength to turn on the MAGFET. In a further embodiment, switch 55 is a micro-electro-mechanical system (MEMS) switch. In a further embodiment, the switch 55 is a magneto resistive device that has a large resistance in the absence of a magnetic field and has a very small resistance in the presence of a magnetic field. When the telephone handset magnet 22 is close enough to the hearing aid wearer's ear, the magnetic field produced by magnet 22 changes the state of switch (e.g., closes) switch 55. Consequently, the base of switch 51 and the base of switch 52 are now grounded. Switches 51 and 52 stop conducting and microphone ground is no longer grounded. That is, the microphone circuit is open. Now switch 52 no longer draws the current away from the base of switch 53 and same is energized by the hearing aid voltage source through resistor 59. Switch 53 is now conducting. Switch 53 connects the voice pickup coil ground to ground and completes the circuit including the voice coil pickup 32 and signal processing circuit 34. Accordingly, the switching circuit 40 activates either the microphone (default) input 31 or the voice coil (magnetic field selected) input 32 but not both inputs simultaneously.

In operation, switch 55 automatically closes and conducts when it is in the presence of the magnetic field produced by telephone handset magnet 22. This eliminates the need for the hearing aid wearer to find the switch, manually change switch state, and then answer the telephone. The wearer can conveniently, merely pickup the telephone handset and place it by his\her ear whereby hearing aid 10 automatically switches from receiving microphone (acoustic) input to receiving pickup coil (electromagnetic) input. That is, a static electromagnetic field causes the hearing aid to switch from an audio input to a time-varying electromagnetic field input. Additionally, hearing aid 10 automatically switches back to microphone input after the telephone handset 14 is removed from the ear. This is not only advantageous when the telephone conversation is complete but also when the wearer needs to talk with someone present (microphone input) and then return to talk with the person on the phone (voice coil input).

The above described embodiment of the switching circuit 40 describes a circuit that grounds an input and open circuits the other inputs. It will be recognized that the switching circuit 40, in an embodiment, connects the power source to an input and disconnects the power source to the other inputs. For example, the collectors of the transistors 51 and 53 are connected to the power source. The switch 55 remains connected to ground. The emitter of transistor 51 is connected to the power input of the microphone 31. The emitter of the transistor 53 is connected to the power input of the voice coil 32. Thus, switching the switch 55 causes the power source to be interrupted to the microphone and supplied to the voice coil pickup32. In an embodiment, switching circuit 40 electrically connects the signal from one input to the processing circuit 34 and opens (disconnects) the other inputs from the processing circuit 34.

While the disclosed embodiment references an in-the-ear hearing aid, it will be recognized that the inventive features of the present invention are adaptable to other styles of hearing aids including over-the-ear, behind-the-ear, eye glass mount, implants, body worn aids, etc. Due to the miniaturization of hearing aids, the present invention is advantageous to many miniaturized hearing aids.

Figure 4:
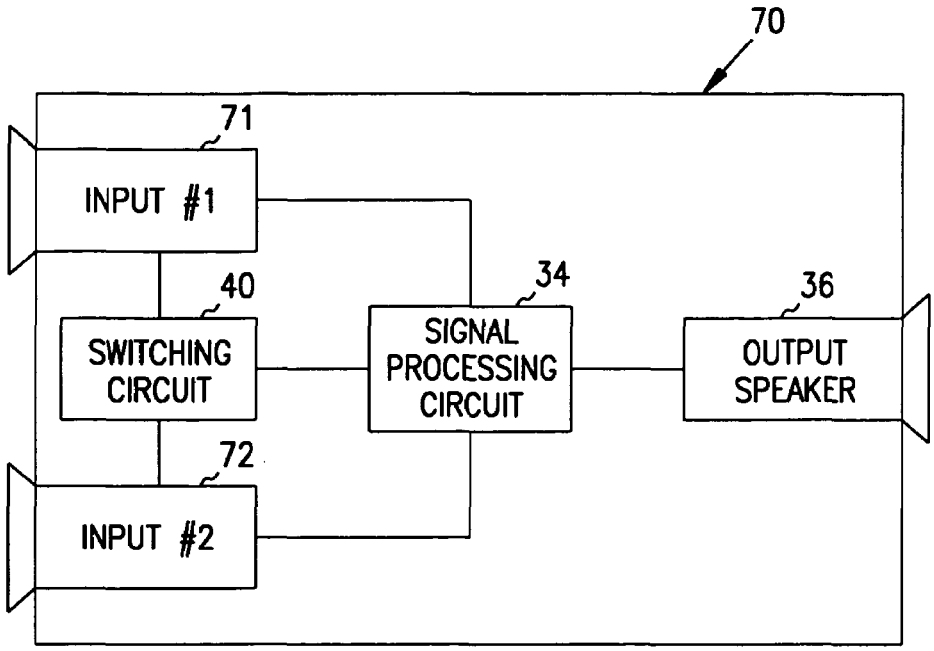
FIG. 4 is a schematic view of a hearing aid according to an embodiment of the present invention.

FIG. 4 shows hearing aid 70. The hearing aid 70 includes a switching circuit 40, a signal processing circuit 34 and an output speaker 36 as described herein. The switching circuit 40 includes a magnetic field responsive, solid state circuit. The switching circuit 40 selects between a first input 71 and a second input 72. In an embodiment, the first input 71 is an omnidirectional microphone, which detects acoustical signals in a broad pattern. In an embodiment, the second input 72 is a directional microphone, which detects acoustical signals in a narrow pattern. The omnidirectional, first input 71 is the default state of the hearing aid 70. When the switching circuit 40 senses the magnetic field, the switch changes state from its default to a magnetic field sensed state. The magnetic field sensed state causes the hearing aid 70 to switch from its default mode and the directional, second input 72 is activated. In an embodiment, the activation of the second input 72 is mutually exclusive of activation of the first input 71.

In use with a telephone handset, e.g., 14 shown in FIG. 1, hearing aid 70 changes from its default state with omnidirectional input 71 active to its directional state with directional input 72 active. Thus, hearing aid 70 receives its input acoustically from the telephone handset. In an embodiment, the directional input 72 is tuned to receive signals from a telephone handset.

In an embodiment, switching circuit 40 includes a micro-electro-mechanical system (MEMS) switch. The MEMS switch includes a cantilevered arm that in a first position completes an electrical connection and in a second position opens the electrical connection. When used in the circuit as shown in FIG. 3, the MEMS switch is used as switch 55 and has a normally open position. When in the presence of a magnetic field, the cantilevered arm shorts the power supply to ground. This initiates a change in the operating state of the hearing aid input.

Figure 5:
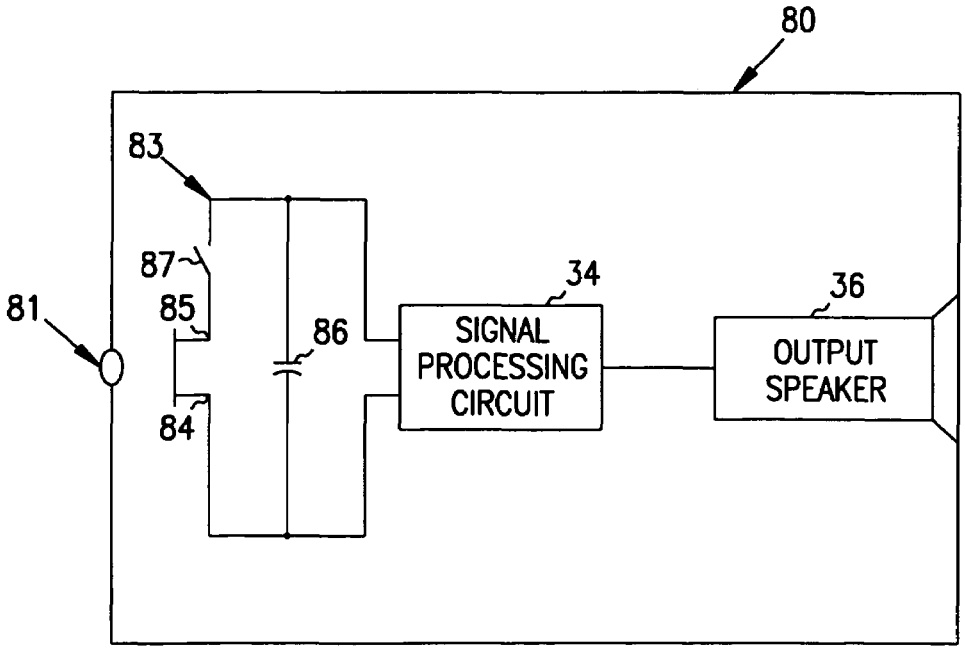
FIG. 5 is a schematic view of a hearing aid according to an embodiment of the present invention.

FIG. 5 shows an embodiment of a hearing aid 80 according to the teachings of the present invention. Hearing aid 80 includes at least one input 81 connected to a signal processing circuit 34, which is connected to an output speaker 36. In an embodiment, hearing aid 80 includes two or more inputs 81 (one shown). The input 81 includes a signal receiver 83 that includes two nodes 84, 85. Node 84 is connected to the signal processing circuit 34 and to one terminal of a capacitor 86. In an embodiment, node 84 is the negative terminal of the input 81. In an embodiment, node 84 is the ground terminal of the input 81. Node 85 is connected to one pole of a magnetically operable switch 87. In an embodiment, the switch 87 is a mechanical switch, such as a reed switch. In an embodiment, the switch 87 is a solid-state, magnetically actuated switch circuit. In an embodiment, the switch 87 is a micro-electro-mechanical system (MEMS). In an embodiment, the solid state switch 87 is a MAGFET. In an embodiment, the solid state switch 87 is a giant magneto-resistivity (GMR) sensor. In an embodiment, the switch 87 is normally open. The other pole of switch 87 is connected to the second terminal of capacitor 86 and to the signal processing circuit 34. Switch 87 automatically closes when in the presence of a magnetic field. When the switch 87 is closed, input 81 provides a signal that is filtered by capacitor 86. The filtered signal is provided to the signal processing circuit 34. The capacitor 86 acts as a filter for the signal sent by the input 81 to the signal processing circuit 34. Thus, switch 87 automatically activates input 81 and filter 86 when in the presence of a magnetic (wireless) field or signal. When the magnetic field is removed, then the switch automatically opens and electrically opens the input 81 and filter 86 from the signal processing circuit 34.

Figure 6:
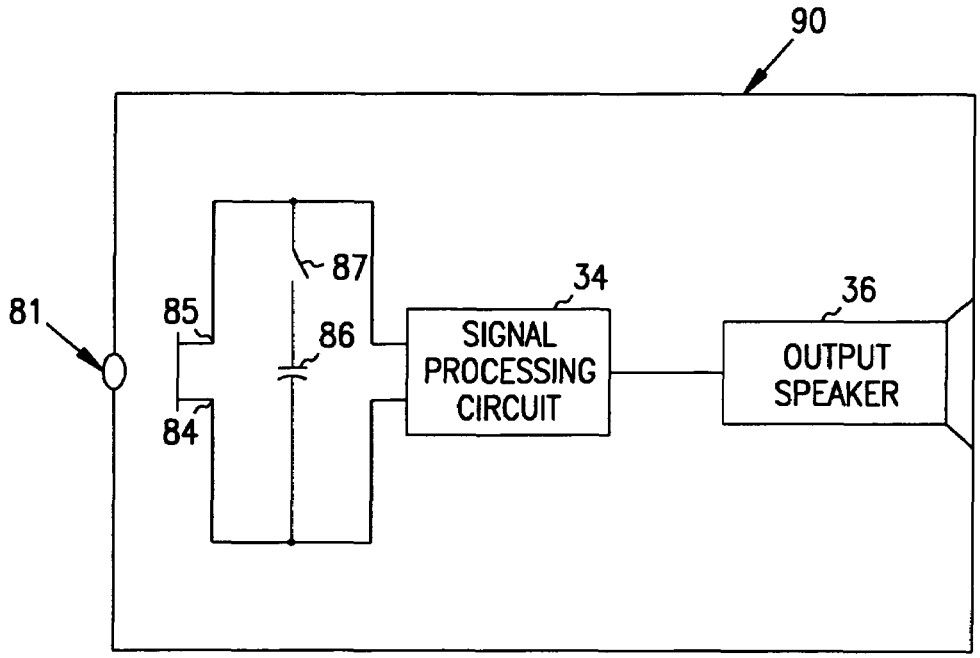
FIG. 6 is a schematic view of a hearing aid according to an embodiment of the present invention.

FIG. 6 shows a further hearing aid 90. Hearing aid 90 includes at least one input 81 having nodes 84, 85 connected to signal processing circuit 34, which is connected to output speaker 36. Node 85 is connected to first pole of switch 87. Node 84 is connected to a first terminal of filter 86. The second pole of switch 87 is connected to the second terminal of filter 86. In an embodiment, the switch 87 is normally open. Accordingly, in the default state of hearing aid 90, the signal sensed by input 81 is sent directly to the signal processing circuit 34. In the switch active state of hearing aid 90, the switch 87 is closed and the signal sent from the input 81 is filtered by filter 86 prior to the signal being received by the signal processing circuit 34. The FIG. 6 embodiment provides automatic signal filtering when the switch 87, and hence the hearing aid 90, is in the presence of a magnetic field.

Figure 7:
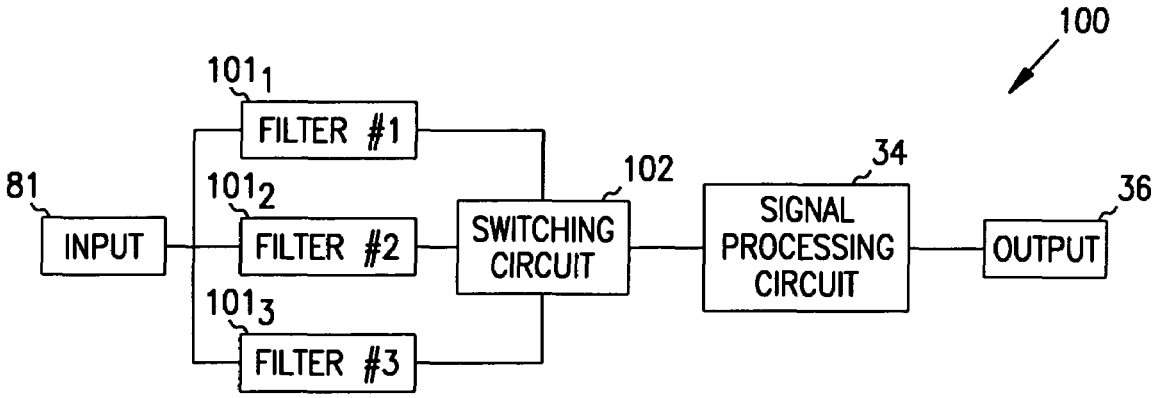
FIG. 7 is a schematic view of a hearing aid according to an embodiment of the present invention.

FIG. 7 shows a further hearing aid 100 that includes input 81, signal processing circuit 34 and output system 36. The input 81 is connected to a plurality of filtering circuits $\mathbf{101}_1$, $\mathbf{101}_2$, $\mathbf{101}_3$. Thus, signal generated by the input 81 is applied to each of the filters 101. Each of the filtering circuits 101 provides a different filter effect. For example, the first filter is a low-pass filter. The second filter is a high-pass filter. The third filter is a low-pass filter. In an embodiment, at least one of filtering circuits $\mathbf{101}_1$, $\mathbf{101}_2$, $\mathbf{101}_3$ includes an active filter. Each of the filters 101 are connected to a switching circuit 102. In an embodiment, the switching circuit 102 is a magnetically actuatable switch as described herein. The switching circuit 102 determines which of the filters 101 provides a filtered signal to the signal processing circuit 34. The processing circuit 34 sends a signal to the output system 36 for broadcasting into the car of the hearing aid wearer. The switching circuit 102 in the absence of a magnetic field electrically connects the first filter $\mathbf{101}_1$ to the signal processing circuit 34 and electrically opens the second filter $\mathbf{101}_2$ and third filter $\mathbf{101}_3$. The switching circuit 102 in the presence of a magnetic field opens the first filter $\mathbf{101}_1$ and electrically connects at least one of the second filter $\mathbf{101}_2$ and third filter $\mathbf{101}_3$ to the signal processing circuit 34. In an embodiment, the second and third filters provide a band-pass filter with both being activated by the switching circuit 102. While the embodiment of FIG. 7 shows the switching circuit 102 positioned between the filters and the hearing aid signal processing circuit 34, the switching circuit 102 is positioned between the input 81 and the filtering circuits $\mathbf{101}_1$, $\mathbf{101}_2$, $\mathbf{101}_3$ in an embodiment of the present invention. In this embodiment, the switching circuit 102 only supplies the input signal from input 81 to the selected filtering circuit(s) $\mathbf{101}_1$, $\mathbf{101}_2$, $\mathbf{101}_3$.

Figure 8:
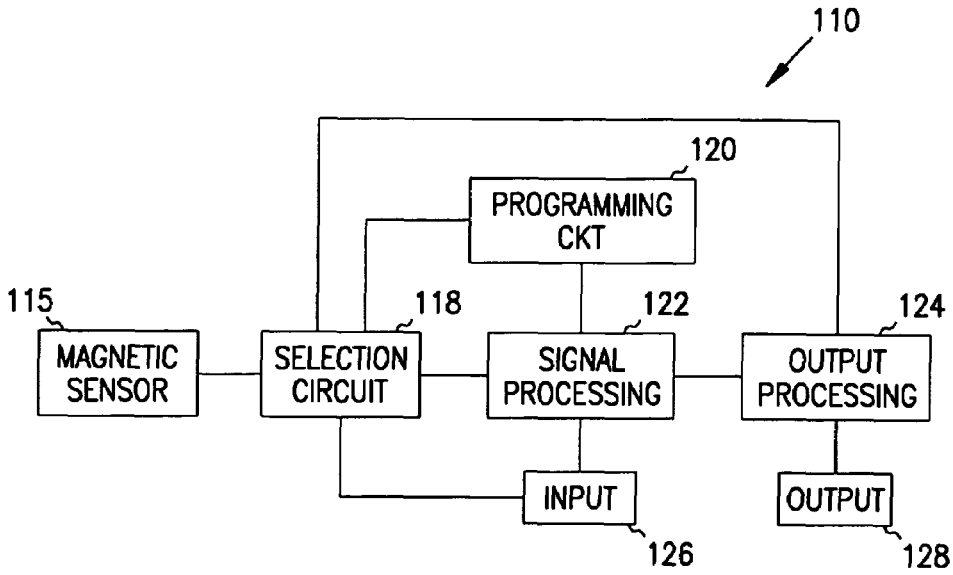
FIG. 8 is a schematic view of a hearing aid according to an embodiment of the present invention.

FIG. 8 shows an embodiment of the present invention including a hearing aid 110 having a magnetic field sensor 115. The magnetic field sensor 115 is connected to a selection circuit 118. The selection circuit 118 controls operation of at least one of a programming circuit 120, a signal processing circuit 122, output processing circuit 124 and an input circuit 126. The sensor 115 senses a magnetic field or signal and outputs a signal to the selection circuit 118, which controls at least one of circuits 120, 122, 124 and 126 based on the signal produced by the magnetic field sensor 115. The signal output by sensor 115 includes an amplitude level that may control which of the circuits that is selected by the selection circuit 118. That is, a magnetic field having a first strength as sensed by sensor 115 controls the input 126. A magnetic field having a second strength as sensed by sensor 115 controls the programming circuit 120. The magnetic field as sensed by sensor 115 then varies from the second strength to produce a digital programming signal. In an embodiment, the signal output by sensor 115 includes digital data that is interpreted by the selection circuit to select at least one of the subsequent circuits. The selection circuit 118 further provides a signal to the at least one of the subsequent circuits. The signal controls operation of the at least one circuit.

In an embodiment, the signal from the selection circuit 118 controls operation of a programming circuit 120. Programming circuit 120 provides hearing aid programmable settings to the signal processing circuit 122. In an embodiment, the magnetic sensor 115 and the selection circuit 118 produce a digital programming signal that is received by the programming circuit 120. Hearing aid 110 is programmed to an individual's specific hearing assistance needs by providing programmable settings or parameters to the hearing aid. Programmable settings or parameters in hearing aids include, but are not limited to, at least one of stored program selection, frequency response, volume, gain, filtering, limiting, and attenuation. The programming circuit 120 programs the programmable parameters for the signal processing circuit 122 of the hearing aid 110 in response to the programming signal received from the magnetic sensor 115 and sent to the programming circuit 120 through selection circuit 118.

In an embodiment, the signal from selection circuit 118 directly controls operation of the signal processing circuit 122. The signal received by the processing circuit 122 controls at least one of the programmable parameters. Thus, while the signal is sent by the magnetic sensor 115 and the selection circuit 118, the programmable parameter of the signal processing circuit 122 is altered from its programmed setting based on the signal sensed by the magnetic field sensor 115 and sent to the signal processing circuit 122 by the selection circuit 118. It will be appreciated that the programmed setting is a factory default setting or a setting programmed for an individual. In an embodiment, the alteration of the hearing aid settings occurs only while the magnetic sensor 115 senses the magnetic field. The hearing aid 110 returns to its programmed settings after the magnetic sensor 115 no longer senses the magnetic field.

In an embodiment, the signal from selection circuit 118 directly controls operation of the output processing circuit 124. The output processing circuit 124 receives the processed signal, which represents a conditioned audio signal to be broadcast into a hearing aid wearer's ear, from the signal processing circuit 122 and outputs a signal to the output 128. The output 128 includes a speaker that broadcasts an audio signal into the user's ear. Output processing circuit 124 includes filters for limiting the frequency range of the signal broadcast from the output 128. The output processing circuit 124 further includes an amplifier for amplifying the signal between the signal processing circuit 122 and the output. Amplifying the signal at the output allows signal processing to be performed at a lower power. The selection circuit 118 sends a control signal to the output processing circuit 124 to control the operation of at least one of the amplifying or the filtering of the output processing circuit 124. In an embodiment, the output processing circuit 124 returns to its programmed state after the magnetic sensor 115 no longer senses a magnetic field.

In an embodiment, the signal from the selection circuit 118 controls operation of the input circuit 126 to control which input is used. For example, the input circuit 126 includes a plurality of inputs, e.g., an audio microphone and a magnetic field input or includes two audio inputs. In an embodiment, the input circuit 126 includes an omnidirectional microphone and a directional microphone. The signal from the selection circuit 118 controls which of these inputs of the input circuit 126 is selected. The selected input sends a sensed input signal, which represents an audio signal to be presented to the hearing aid wearer, to the signal processing circuit 122. In a further example, the input circuit 126 includes a filter circuit that is activated and/or selected by the signal produced by the selection circuit 118.

Figure 9:
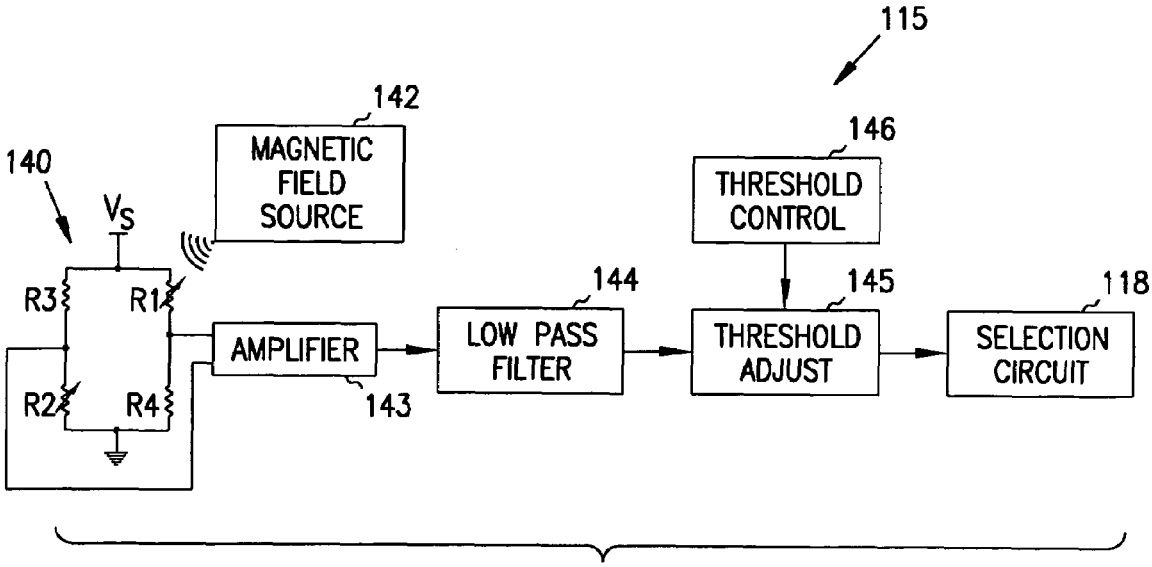
FIG. 9 is a schematic view of a hearing aid according to an embodiment of the present invention.

FIG. 9 shows an embodiment of the magnetic sensor 115. Sensor 115 includes a full bridge 140 that has first node connected to power supply (Vs) and a second node connected ground. The bridge 140 includes third and fourth nodes whereat the sensed signal is output to firther hearing aid circuitry. A first variable resistor R1 is connected between the voltage source and the third node. A second variable resistor R2 is connected between ground and the fourth node. The first and second variable resistors R1 and R2 are both variable based on a wireless signal. In an embodiment, the wireless signal includes a magnetic field signal. A first fixed value resistor R3 is connected between the voltage source and the fourth node. A second fixed value resistor R4 is connected between ground and the third node. The bridge 140 senses an electromagnetic field produced by a source 142 and produces a signal that is fed to an amplifier 143. Both the first and second variable resistors R1 and R2 vary in response to the magnetic field produced by magnetic field source 142. Amplifier 143 amplifies the sensed signal. A low pass filter 144 filters high frequency components from the signal output by the amplifier 143. A threshold adjust circuit 145, which is controlled by threshold control circuit 146, adjusts the level of the signal prior to supplying it to the selection circuit 118. In an embodiment, the threshold adjust circuit 145 holds the level of the signal below a maximum level. The maximum level is set by the threshold control circuit 146.

Figure 10:
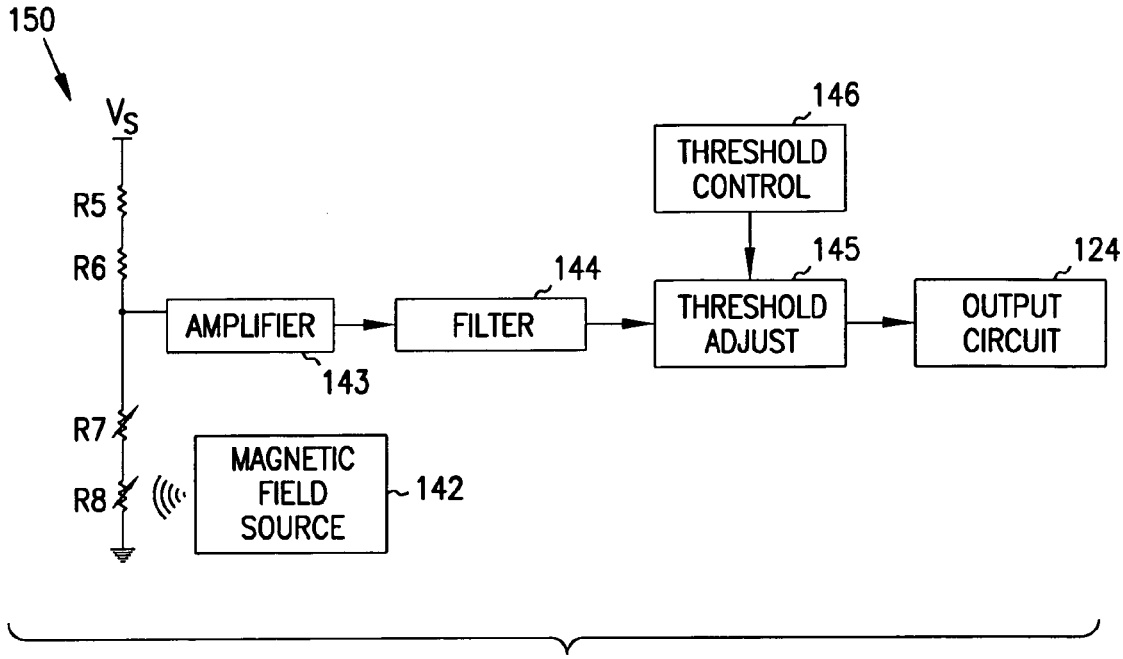
FIG. 10 is a schematic view of an embodiment of the present invention.

FIG. 10 shows a further embodiment of magnetic sensor 115, which includes a half bridge 150. The half bridge 150 includes two fixed resistors R5, R6 connected in series between a voltage source and the output node. Bridge 150 further includes two variable resistors R7, R8 connected in series between ground and the output node. The two variable resistors R7, R8 sense the electromagnetic field produced by the magnetic field source 142 to produce a corresponding signal at the output node. The amplifier 143, filter 144, threshold adjust circuit 145 and selection circuit 118 are similar to the circuits described herein.

The magnetic sensor 115, in either the full bridge 140 or half bridge 150, includes a wireless signal responsive, solid state device. The solid state sensor 115, in an embodiment, includes a giant magnetoresistivity (GMR) device, which relies on the changing resistance of materials in the presence of a magnetic field. One such GMR sensor is marketed by NVE Corp. of Eden Prairie, Minn. under part no. AA002-02. In one embodiment of a GMR device, a plurality of layers are formed on a substrate or wafer to form an integrated circuit device. Integrated circuit devices are desirable in hearing aids due to their small size and low power consumption. A first layer has a fixed direction of magnetization. A second layer has a variable direction of magnetization that depends on the magnetic field in which it is immersed. A nonmagnetic, conductive layer separates the first and second magnetic layers. When the direction of magnetization of the first and second layers are the same, the resistance across the GMR device layer is low. When the direction of magnetization of the second layer is at an angle with respect to the first layer, then the resistance across in the layers increases. Typically, the maximum resistance is achieved when the direction of magnetization are at an angle of about 180 degrees. Such GMR devices are manufactured using VLSI fabrication techniques. This results in magnetic field sensors having a small size, which is also desirable in hearing aids. In an embodiment, a GMR sensor of the present invention has an area of about 130 mil by 17 mil. It will be appreciated that smaller GMR sensors are desirable for use in hearing aids if they have the required sensitivity and bandwidth. Further, some hearing aids are manufactured on a ceramic substrate that will form a base layer on which a GMR sensor is fabricated. GMR sensors have a low sensitivity and thus must be in a strong magnetic field to sense changes in the magnetic field. Further, magnetic field strength depends on the cube of the distance from the source. Accordingly, when the GMR sensor is used to program a hearing aid, the magnetic field source 142 must be close to the GMR sensor. As a example, a programming coil of the source 142 is positioned about 0.5 cm from the GMR sensor to provide a strong magnetic field to be sensed by the magnetic field sensor 115.

When the GMR sensor is used in the hearing aid circuits described herein, the GMR sensor acts as a switch when it senses a magnetic field having at least a minimum strength. The GMR sensor is adapted to provide various switching functions. The GMR sensor acts as a telecoil switch when it is placed in the DC magnetic field of a telephone handset in a first function. The GMR sensor acts as a filter-selecting switch that electrically activates or electrically removes a filter from the signal processing circuits of a hearing aid in an embodiment. The GMR sensor acts to switch the hearing aid input in an embodiment. For example, the hearing aid switches between acoustic input and magnetic field input. As a further example, the hearing aid switches between omnidirectional input and directional input. In an embodiment, the GMR sensor acts to automatically turn the power off when a magnetic field of sufficient strength changes the state, i.e., increases the resistance, of the GMR sensor.

The GMR sensor is adapted to be used in a hearing aid to provide a programming signal. The GMR sensor has a bandwidth of at least 1 MHz. Accordingly, the GMR sensor has a high data rate that is used to program the hearing aid during manufacture. The programming signal is a digital signal produced by the state of the GMR sensor when an alternating or changing magnetic field is applied to the GMR sensor. For example, the magnetic field alternates about a threshold field strength. The GMR sensor changes its resistance based on the magnetic field. The hearing aid circuit senses the change in resistance and produces a digital (high or low) signal based on the GMR sensor resistance. In a further embodiment, the GMR sensor is a switch that activates a programming circuit in the hearing aid. The programming circuit in an embodiment receives audio signals that program the hearing aid. In an embodiment, the audio programming signal is broadcast through a telephone network to the hearing aid. Thus, the hearing aid is remotely programmed over a telephone network using audio signals by non-manually switching the hearing aid to a programming mode. In an embodiment, the hearing aid receives a variable magnetic signal that programs the hearing aid. In an embodiment, the telephone handset produces the magnetic signal. The continuous magnetic signal causes the hearing aid to switch on the programming circuit. The magnetic field will remain above a programming threshold. The magnetic field varies above the programming threshold to produce the programming signal that is sensed by the magnetic sensor and programs the hearing aid. In a further embodiment, a hearing aid programmer is the source of the programming signal.

The solid state sensor 115, in an embodiment, is an anisotropic magneto resistivity (AMR) device. An AMR device includes a material that changes its electrical conductivity based on the magnetic field sensed by the device. An example of an AMR device includes a layer of ferrite magnetic material. An example of an AMR device includes a crystalline material layer. In an embodiment, the crystalline layer is an orthorhombic compound. The orthorhombic compound includes RCu2 where R=a rare earth element). Other types of anisotropic materials include anisotropic strontium and anisotropic barium. The AMR device is adapted to act as a hearing aid switch as described herein. That is, the AMR device changes its conductivity based on a sensed magnetic field to switch on or off elements or circuits in the hearing aid. The AMR device, in an embodiment, is adapted to act as a hearing aid programming device as described herein. The AMR device senses the change in the state of the magnetic field to produce a digital programming signal in the hearing aid.

The solid state sensor 115, in an embodiment, is a spin dependent tunneling (SDT) device. Spin dependent tunneling (SDT) structures include an extremely thin insulating layer separating two magnetic layers. The conduction is due to quantum tunneling through the insulator. The size of the tunneling current between the two magnetic layers is modulated by the magnetization directions in the magnetic layers. The conduction path must be perpendicular to the plane of a GMR material layer since there is such a large difference between the conductivity of the tunneling path and that of any path in the plane. Extremely small SDT devices with high resistance are fabricated using photolithography allowing very dense packing of magnetic sensors in small areas. The saturation fields depend upon the composition of the magnetic layers and the method of achieving parallel and antiparallel alignment. Values of a saturation field range from 0.1 to 10 kA/m (1 to 100 Oe) offering the possibility of extremely sensitive magnetic sensors with very high resistance suitable for use with battery powered devices such as hearing aids. The SDT device is adapted to be used as a hearing aid switch as described herein. The SDT device is further adapted to provide a hearing aid programming signals as described herein.

Figure 11:
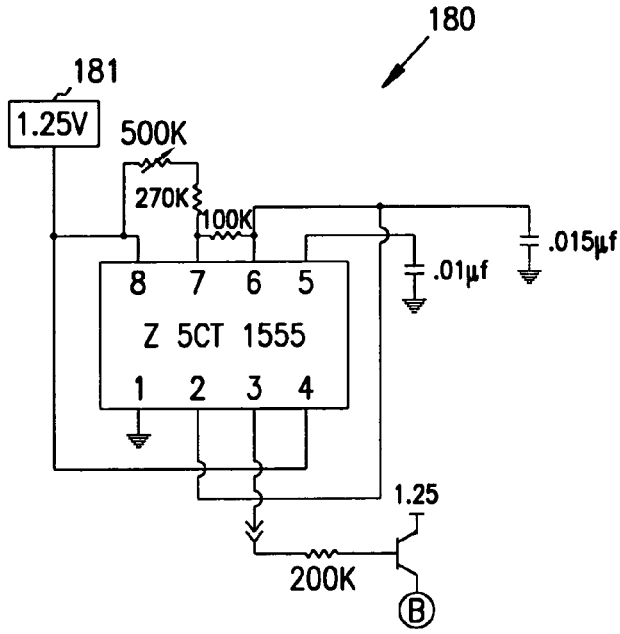
FIG. 11 is a circuit diagram of a power source of an embodiment of the present invention.

Hearing aids are powered by batteries. In an embodiment, the battery provides about 1.25 Volts. A magnetic sensor, e.g., bridges 140 or 150, sets the resistors at 5K ohms, with the variable resistors R1, R2 or R7, R8 varying from the 5K ohm dependent on the magnetic field. In this embodiment, the magnetic sensor 140 or 150 would continuously draw about 250 μA. It is desirable to limit the power draw from the battery to prolong the battery life. One construction for limiting the power drawn by the sensor 140 or 150 is to pulse the supply voltage Vs. FIG. 11 shows a pulsed power circuit 180 that receives the 1.25 Volt supply from the hearing aid battery 181. Pulsed power circuit 180 includes a timer circuit that is biased (using resistors and capacitors) to produce a 40 Hz pulsed signal that has a pulse width of about 2.8 μsec. and a period of about 25.6 μsec for a duty cycle of about 0.109.

Such, a pulsed power supply uses only about a tenth of the current that a continuous power supply would require. Thus, with a GMR sensor that continuously draws 250 μA, would only draw about 25 μA with a pulsed power supply. In the specific embodiment, the current drain on the battery would be about 27 μA (0.109*250 μA). Accordingly, the power savings of a pulsed power supply versus a continuous power supply is about 89.1%.

Figure 12:
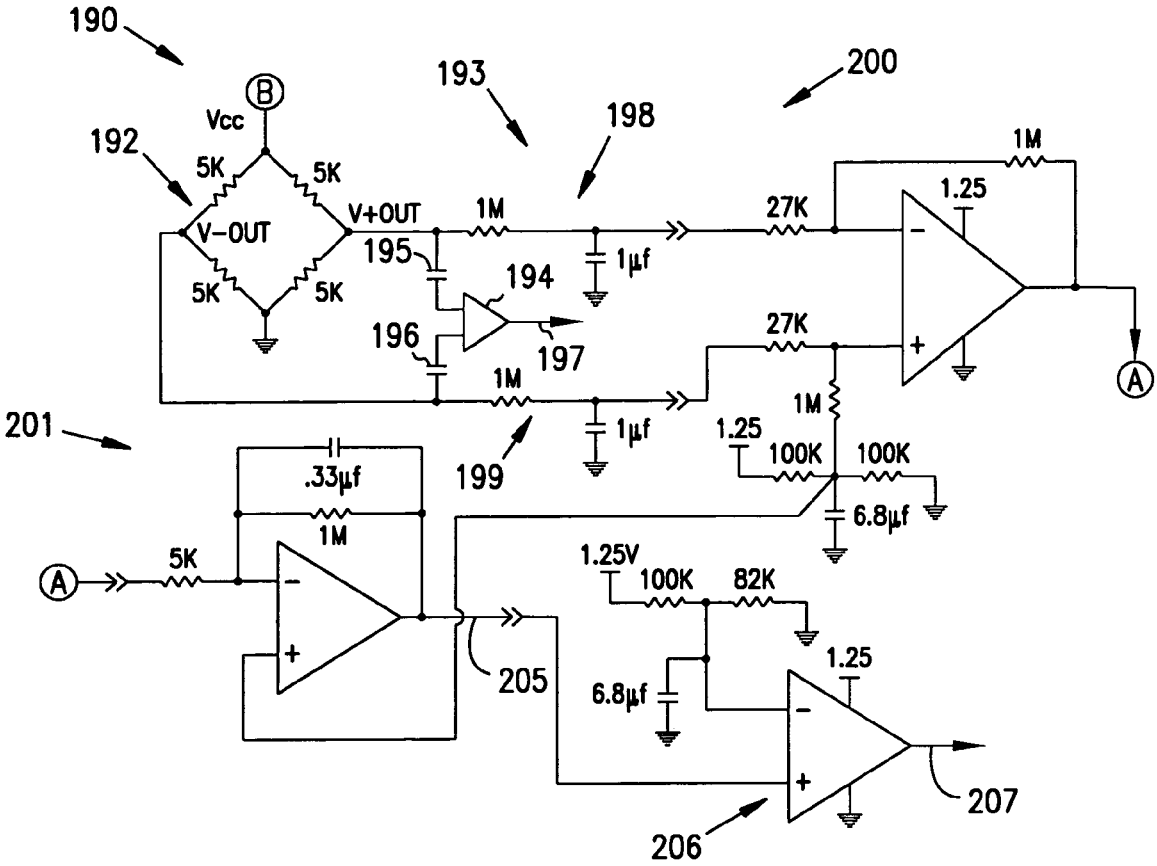
FIG. 12 is a circuit diagram of an embodiment of the present invention.

FIG. 12 shows an embodiment of a GMR sensor circuit 190 that operates as both a hearing aid state changing switch and as a programming circuit. Circuit 190 includes a sensing stage 192, followed by a high frequency signal stage 193, which is followed by a bi-state sensing and switch stage 201. The hearing aid state changing switch is adaptable to provide any of bi-states of the hearing aid, for example, changing inputs, changing filters, turning the hearing aid on or off, etc. The GMR sensor circuit 190 includes a full bridge 192 that receives a source voltage, for example, Vs or the output from the pulse circuit 180. Vs is, in an embodiment, the battery power. The bridge 192 outputs a signal to both the signal stage 193 and the switch stage 201. The positive and negative output nodes of the full bridge 192 are respectively connected to the non-inverting and inverting terminals of an amplifier 194 through capacitors 195, 196. The amplifier is part of the signal stage 193. In an embodiment, the output 197 of the amplifier 194 is a digital signal that is used to program the hearing aid. The hearing aid programming circuit, e.g., programming circuit 120, receives the digital signal 197 from the amplifier 194. The signal 197, in an embodiment, is the audio signal that is inductively sensed by bridge 192 and is used as an input to the hearing aid signal processing circuit.

The switching stage 201 includes filters to remove the high frequency component of the signal from the induction sensor. The positive and negative output nodes of the full bridge 192 are each connected to a filter 198, 199. Each filter 198, 199 includes a large resistor (1M ohm) and a large capacitor (1 μf). The filters 198, 199 act to block false triggering of the on/off switch component 200 of the circuit 190. The signals that pass filters 198, 199 are fed through a series of amplifiers to determine whether an electromagnetic field is present to switch the state of the hearing aid. An output 205 is the on/off signal from the on/off switch component 200. The on/off signal is used to select one of two states of the hearing aid. The state of the hearing aid, in an embodiment, is between an audio or electromagnetic field input. In another embodiment, the state of the hearing aid is either an omni-directional input or directional input. In an embodiment, the state of the hearing aid is a filter acting on a signal in the hearing aid or not. In an embodiment, the signal 205 is sent to a level detection circuit 206. Level detection circuit 206 outputs a digital (high or low) signal 207 based on the level of signal 205. In this embodiment, signal 207 is the signal used for switching the state of the hearing aid.

Figure 13:
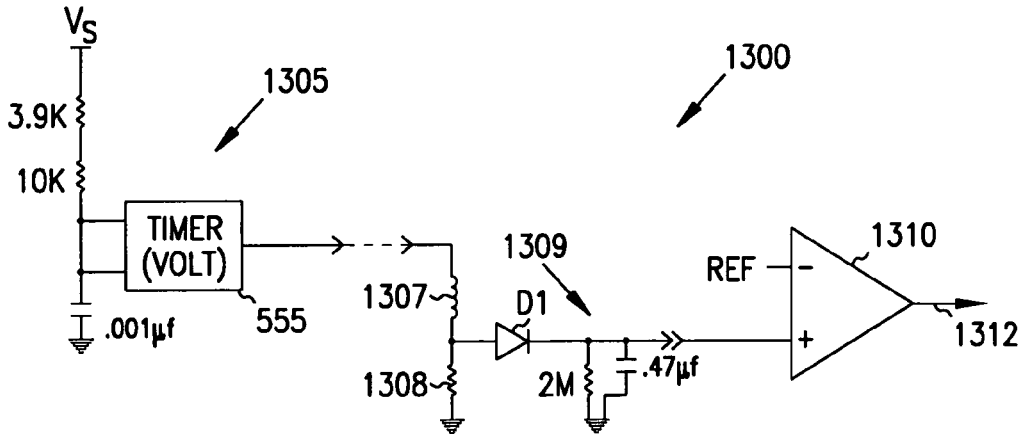
FIG. 13 is a circuit diagram of an embodiment of the present invention.

FIG. 13 shows a saturated core circuit 1300 for a hearing aid. The saturated core circuit 1300 senses a magnetic field and operates a switch or provides a digital programming signal. A pulse circuit 1305 connects the saturated core circuit to the power supply Vs. Pulse circuit 1305 reduces the power consumption of the saturated core circuit 1300 to preserve battery life in the hearing aid. The pulse circuit 1305 in the illustrated embodiment outputs a 1 MHz signal, which is fed to a saturatable core, magnetic field sensing device 1307. In an embodiment, the device includes a magnetic field sensitive core wrapped by a fine wire. The core in an example is a 3.0×0.3 mm core. In an embodiment, the core is smaller than 3.0×0.3 mm. The smaller the core, the faster it responds to magnet fields and will saturate faster with a less intense magnetic field. An example of a saturated core is a telecoil marketed by Tibbetts Industries, Inc. of Camden, Me. However, the present invention is not limited to the Tibbetts Industries telecoil. In a preferred embodiment of the invention, the saturatable core device 1307 is significantly smaller than a telecoil so that the device will saturate faster in the presence of the magnetic field. The device 1307 changes in A.C. impedance based on the magnetic field surrounding the core. The core has a first impedance in the presence of a strong magnetic field and a second impedance when outside the presence of a magnetic field. A resistor 1308 connects the device 1307 to ground. In an embodiment, the resistor 1308 has a value of 100 KOhms. The node intermediate the device 1307 and resistor 1308 is a sensed signal output that is based on the change in impedance of the device 1307. Accordingly, the saturable core device 1307 and resistor 1308 act as a half bridge or voltage divider. The electrical signal produced by the magnetic field sensing device 1307 and resistor 1308 is sent through a diode D1 to rectify the signal. A filter 1309 filters the rectified signal and supplies the filtered signal to an input of a comparator 1310. The comparator 1310 compares the signal produced by the filter and magnetic field sensor to a reference signal to produce output signal 1312. In an embodiment, the signal output through the core device 1307 varies +/−40 mV depending on the magnetic field in which the saturable core device 1307 is placed. In an embodiment, it is preferred that the magnetic field is of sufficient strength to move the saturable core device into saturation. While device 1307 is shown as a passive device, in an embodiment of the present invention, device 1307 is a powered device. In an embodiment, the saturatable device 1307 acts a non-manual switch that activates or removes circuits from the hearing aid circuit. For example, the saturatable device 1307 acts to change the input of the hearing aid in an embodiment. In a further embodiment, the saturated core circuit 1300 activates or removes a filter from the hearing aid circuit based on the state of the output 1312 . In a further embodiment, the saturatable core device 1307 is adapted to be a telecoil switch. In a further embodiment, the saturatable core device 1307 is adapted to act as a automatic, non-manual power on/off switch. In a further embodiment, the saturatable core 1307 is a programming signal receiver.

Figure 14:
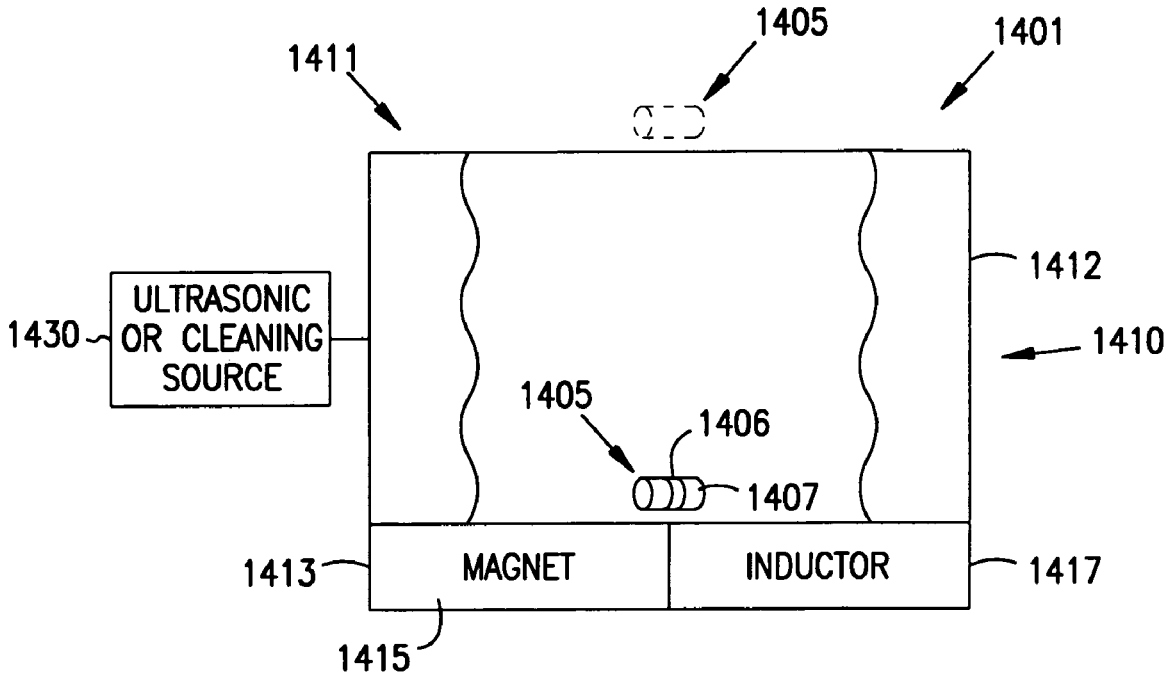
FIG. 14 is a schematic view of a hearing aid cleaning and charging system according to an embodiment of the present invention.

FIG. 14 shows a system 1401 including a hearing aid 1405 and a hearing aid storage receptacle 1410. Receptacle 1410 is cup-like with an open top 1411, an encircling sidewall 1412 upstanding from a base 1413. The receptacle 1410 is adapted to receive the hearing aid 1405 and store it adjacent a magnetic field source 1415. The receptacle base 1413 houses the magnetic field source 1415. Thus, when the hearing aid 1405 is in the receptacle (shown in solid line in FIG. 14), the hearing aid is in the magnetic field. In an embodiment, the magnetic field experienced by the hearing aid in the receptacle is the near field. When the hearing aid 1405 is out of receptacle (broken line showing in FIG. 14), the hearing aid is out of the magnetic field, i.e., the magnetic field does not have sufficient strength as sensed by the magnetic field sensor of hearing aid 1405 to trigger a state changing signal in the hearing aid 1405. In an embodiment, the hearing aid 1405 includes a magnetically-actuated switch 1406. The magnetically-actuated switch 1406 is a normally on (conducting) switch that connects the power supply to the hearing aid circuit. When the hearing aid 1405 is in the receptacle, the magnetically-actuated switch changes to a non-conducting state and the power supply is electrically disconnected from the hearing aid circuit. Thus, hearing aid 1405 is placed in a stand-by mode. The stand-by mode reduces power consumption by the hearing aid. This extends hearing aid battery life. Moreover, this embodiment eliminates the need for the hearing aid wearer to manually turn off the hearing aid after removing it. The wearer merely places the hearing aid 1405 in the storage receptacle 1410 and the hearing aid 1405 turns off or is placed in a stand-by mode. Non-essential power draining circuits are turned off. Non-essential circuits include those that are used for signal processing that are not needed when the hearing aid wearer removes the hearing aid. The stand-by mode is used so that any programmable parameters stored in the hearing aid 1405 are saved in memory by power supplied to the hearing aid memory. The programmable parameters are essential parameters that are stored in the hearing aid and should not be deleted with the power being turned off. The programmed parameters include the volume level. Thus, when the hearing aid 1405 is removed from the receptacle 1410, the hearing aid is automatically powered by the normally on switch 1406 electrically 10 reconnecting the hearing aid signal processing circuit to the power supply and the hearing aid 1405 returns to the stored volume level without the wearer being forced to manually adjust the volume level of the hearing aid.

The hearing aid storage system 1401, in an embodiment, includes a magnetic field source 1415 that produces a magnetic field that is significantly greater, e.g., at least 3-4 times as great, as the constant magnetic field and/or the varying magnetic field of a telephone handset. This allows the hearing aid 1405 to include both the automatic switch 40 that alternates inputs based on a magnetic field of a first threshold and the automatic power-off switch 1406 that turns off the hearing aid based on a magnetic field of a higher threshold. Thus, hearing aid 1405 includes automatically switching between inputs, filters, settings, etc. as described herein and automatically powering down to preserve battery power when the hearing aid is in the storage receptacle 1410.

In another embodiment of the present invention, the hearing aid 1405 further includes a rechargeable power supply 1407 and a magnetically actuated switching circuit 1406 as described herein. The rechargeable power supply 1407 includes at least one of a rechargeable battery. In an embodiment, rechargeable power supply 1407 includes a capacitor. In an embodiment, a power induction receiver is connected to the rechargeable power supply 1407 through the switching circuit 1406. The receptacle 1410 includes a power induction transmitter 1417 and magnetic field source 1415. When the hearing aid 1405 is positioned in the receptacle 1410, the magnetic switch 1406 turns on a power induction receiver of the rechargeable power supply 1407. The power induction receiver receives a power signal from the power induction transmitter 1417 to charge the power supply 1407. Thus, whenever the hearing aid 1405 is stored in the receptacle 1410, the hearing aid power supply 1407 is recharged. In an embodiment, the magnetically actuated switch 1406 electrically disconnects the hearing aid circuit from the hearing aid power supply 1407 and activates the power induction receiver to charge the hearing aid power supply. As a result, the hearing aid power supply 1407 is recharged when the hearing aid is not in use by the wearer.

In a further embodiment, the system 1401 includes a cleaning source 1430 connected to the storage receptacle 1410. The cleaning source 1430 supplies sonic or ultrasonic cleaning waves inside the receptacle 1411. The waves are adapted to clean the hearing aid 1405. Accordingly, the hearing aid 1405 is automatically cleaned when placed in the receptacle 1411.

Figure 15:
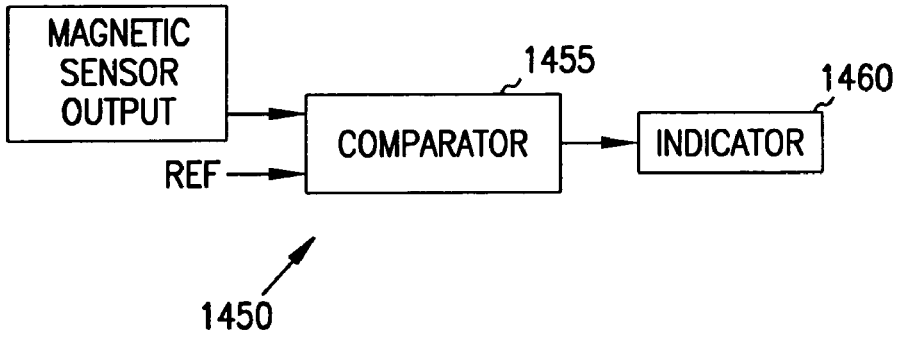
FIG. 15 is a view of hearing aid switch of the present invention and a comparator/indicator circuit.

FIG. 15 shows a further embodiment of the hearing aid switch 1406 that includes an indicator circuit 1450. Indicator circuit 1450 is adapted to produce an indicator signal to the hearing aid user. In an embodiment, the indicator circuit 1450 is connected to a magnetic field sensor, e.g. sensor 115, 190 or 1300. The indicator circuit provides an indication signal that indicates that the magnetic field sensor 190 or 1300 is sensing the magnetic field. In an embodiment, the indicator circuit indicates that the hearing aid has been disconnected from the power supply. In an embodiment, the indicator circuit indicates that the hearing aid power supply is being recharged by the recharging circuit 1417. Indicator circuit 1450 includes a comparator 1455 that receives the output signal from the magnetic field sensor circuit 190 or 1300 and compares the received output signal to a threshold value and based on the comparison sends a signal to an indicator 1460 that produces the indicator signal. The indicator signal is a visual signal produced by a low power LED.

Figure 16:
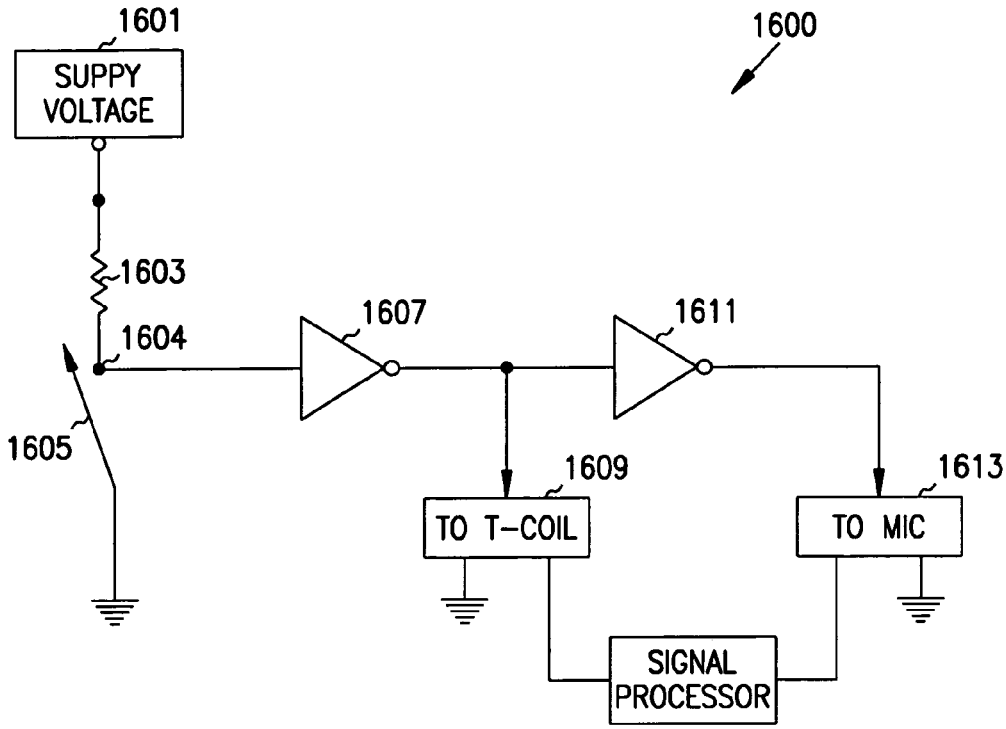
FIG. 16 is a diagram of a switching circuit according to an embodiment of the present invention.

FIG. 16 shows a hearing aid switch circuit 1600. Circuit 1600 switches the power from one input to another input. In an embodiment, one input is an induction input and the other input is an audio input. In an embodiment, circuit 1600 exclusively powers one of the inputs. Circuit 1600 includes a power supply 1601 connected to a resistor 1603 at node 1604. Hence, node 1604 is at a high, non-groung potential. In an embodiment, the power supply is a hearing aid battery power supply. In an embodiment, the power supply is in the range of 1.5 to 0.9 volts. In an embodiment, the resistor 1603 is a 100 KOhm. The resistor 1603 is connected to a non-manual switch 1605 that is connected to ground. Switch 1605, in an embodiment, is a magnetically actuatable switch as described herein. An input to first inverter 1607 is connected to node 1604. The output of inverter 1607 is connected to the input of a first hearing aid input 1609 and an input of a second inverter 1611. The output of the second inverter 1611 is connected to a second hearing aid input 1613. In an embodiment, first and second inverters 1607 and 1611 are Fairchild ULP-A NC7SV04 inverters. The inverters have an input voltage range from 0.9V to 3.6V.

The circuit 1600 has two states. In the first state, which is illustrated, the switch 1605 is open. The node 1604 is at a high voltage. Inverter 1607 outputs a low signal, which is supplied to both the first input 1609 and the second inverter 1611. The first input 1609 is off when it receives a low signal. The second inverter 1611 outputs a high, on signal to the second input 1613. Accordingly, in the open switch state of circuit 1600, the first input 1609 is off and the second input 1613 is on. When in the presence of a magnetic field, switch 1605 closes. Node 1604 is connected to ground and, hence, is at a low potential. Inverter 1607 outputs a high, on signal to the first input 1609 and second inverter 1611. The first input 1609 is on, i.e., powered. The second inverter 1611 outputs a low, off signal to second input 1613. Accordingly, in the closed switch state of circuit 1600, the first input 1609 is on and the second input 1613 is off. In an embodiment, the first hearing aid input 1609 is an induction input and the second hearing aid input 1613 is an audio input. Thus, in the switch open state, the second, audio input 1613 is on or powered and the first, induction input 1609 is off or unpowered. In the switch closed state, the first, induction input 1609 is on or powered and the second, audio input 1613 is off. The circuit 1600 is used as an automatic, induction telephone signal input circuit.

Figure 17:
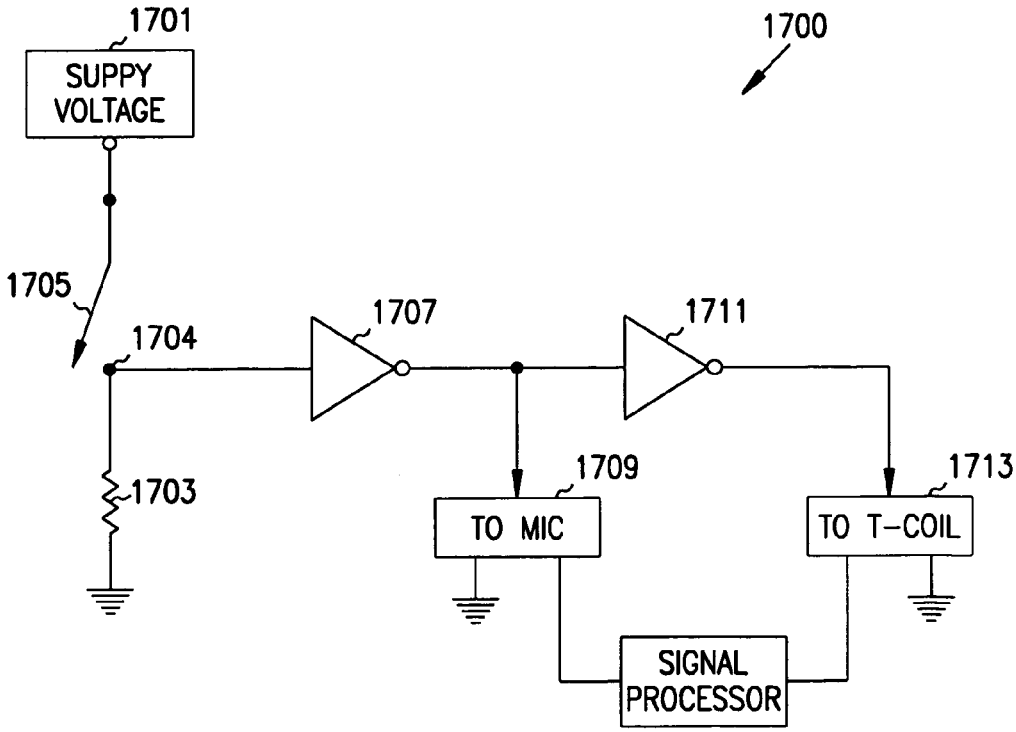
FIG. 17 is a diagram of a switching circuit according to an embodiment of the present invention.

FIG. 17 shows a hearing aid switch circuit 1700. Circuit 1700 is similar to circuit 1600, like elements are designated with the same two least significant digits and the two most significant digit refer to the figure on which they appear. In circuit 1700, the switch 1705 is connected to the voltage supply 1701. Resistor 1703 is connected between node 1704 and ground. The input of first inverter 1707 is connected to node 1704. The output of first inverter 1707 is connected to the first input 1709 and the input of the second inverter 1711. The output of the second inverter 1711 is connected to the second input 1713.

The circuit 1700 has two states. In the first state, which is illustrated, the switch 1705 is open. The node 1704 is grounded by resistor 1703 and is at a low potential. Inverter 1707 outputs a high signal, which is supplied to both the first input 1709 and the second inverter 1711. The first input 1709 is on when it receives a high signal. The second inverter 1711 outputs a low, off signal to the second input 1713. Accordingly, in the open switch state of circuit 1700, the first input 1709 is on and the second input 1713 is off. When in the presence of a magnetic field, switch 1705 closes. Node 1704 is connected to the voltage supply through closed switch 1705 and, hence, is at a high potential. Inverter 1707 outputs a low, off signal to the first input 1709 and second inverter 1711. The first input 1709 is off, i.e., unpowered. The second inverter 1711 outputs a high, on signal to second input 1713. Accordingly, in the closed switch state of circuit 1700, the first input 1709 is off and the second input 1713 is on. In an embodiment, the first hearing aid input 1709 is an audio input and the second hearing aid input 1713 is an induction input. Thus, in the switch open state, the first, audio input 1709 is on or powered and the second, induction input 1713 is off or unpowered. In the switch closed state, the first, audio input 1709 is off and the second, induction input 1713 is on or powered. The circuit 1700 is used as an automatic, induction telephone signal input circuit. Further, circuit 1700 does not continually incur the loss associated with resistor 1703. The default state of the circuit 1700 is with the resistor 1703 grounded and no power drain occurs across resistor 1703. In circuit 1600, there is a continuous power loss associated with resistor 1603. Power conservation and judicious use of the battery power in a hearing aid is a significant design characteristic.

Figure 18:
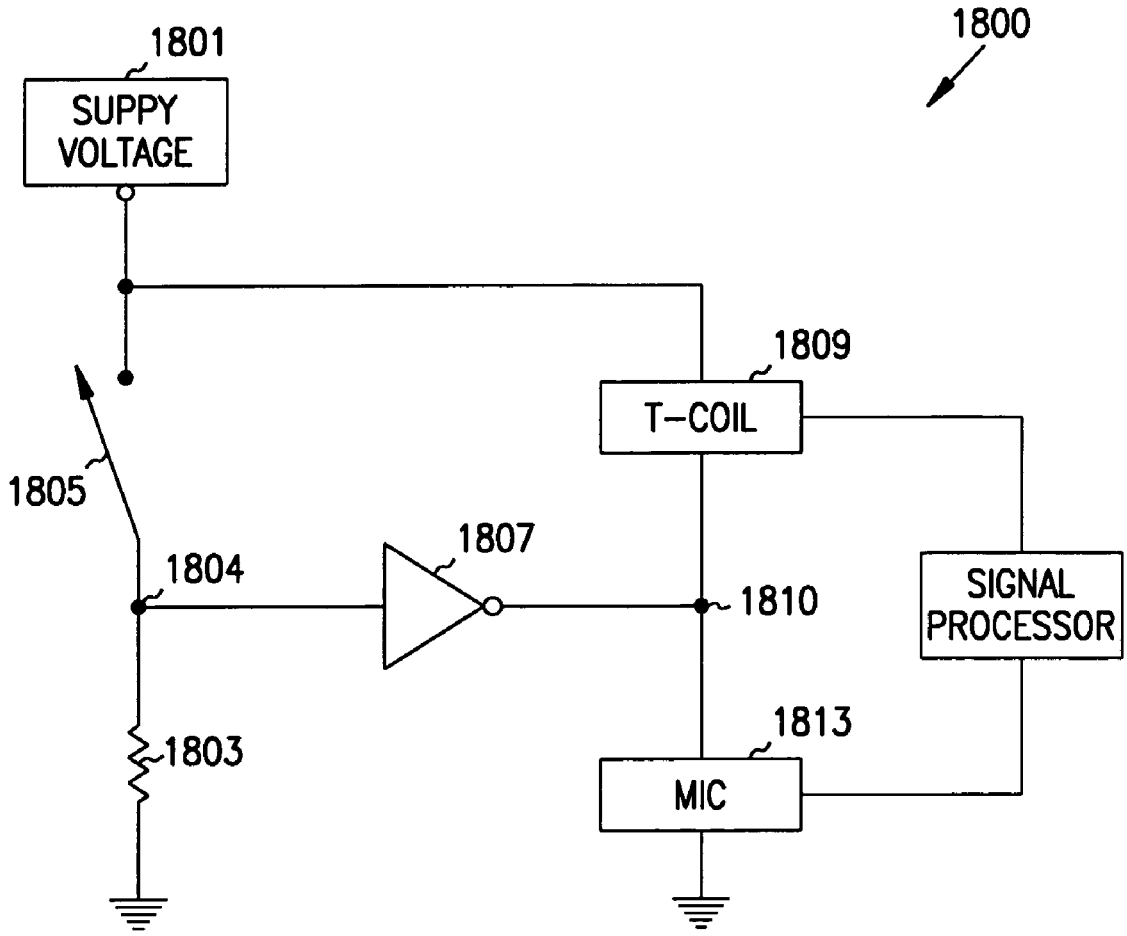
FIG. 18 is a diagram of a switching circuit according to an embodiment of the present invention.

FIG. 18 shows a hearing aid switch circuit 1800. Circuit 1800 includes a supply voltage 1801 connected to an induction, first hearing aid input 1809 and a non-manual switch 1805. Switch 1805, in an embodiment, is a magnetic field actuatable switch as described herein. A resistor 1803 connects a node 1804 to ground. Switch 1805 is connected to node 1804. Inverter 1807 is connected to node 1810. Both first input 1809 and an audio, second hearing aid input 1813 are connected to node 1810. Second input 1813 is connected to ground. Circuit 1800 has two states. In a first, switch open state node 1804 is connected to ground through resistor 1803. The inverter 1807 outputs a high signal to node 1810. The high signal turns on or powers the second input 1813. The high signal at node 1810 is a high enough voltage to hold the potential across the first input 1809 to be essential zero. In an embodiment, the high signal output by inverter 1807 is essentially equal to the supply voltage 1801. Thus, the first input 1809 is off In a second, switch closed state, node 1804 is at a high potential. Inverter 1807 outputs a low signal. In an embodiment, the low signal is essentially equal to ground. The potential across the first input 1809 is the difference between the supply voltage and the low signal. The potential across the first input 1809 is enough to turn on the first input. The low signal is low enough so that there is no potential across the second input 1813. Thus, the first input 1809 is on and the second input 1813 is off in the closed switch state of circuit 1800.

While the above embodiments described in conjunction with FIGS. 16-18 include inverters, it will be recognized that the other logic circuit elements could be used. The logic circuit elements include NAND, NOR, AND and OR gates. The use of logic elements, inverters and other logic gates, is a preferred approach as these elements use less power than the transistor switch circuit as shown in FIG. 3.

The above embodiments described in conjunction with FIGS. 16-18 include switching between hearing aid inputs by selectively powering the inputs based on the state of a switch. It will be recognized that the switching circuits are adaptable to the other switching applications described herein. For example, the switching circuits 1600, 1700, or 1800 switch between an omni-directional input and a directional input.

Figure 19:
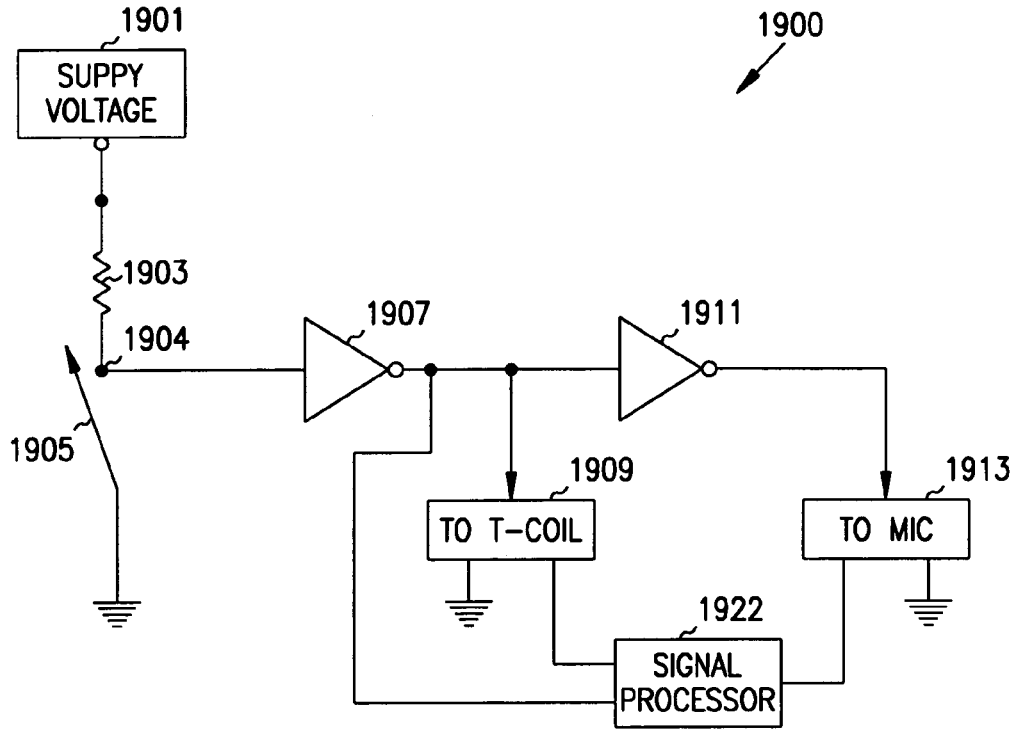
FIG. 19 is a diagram of a switching circuit according to an embodiment of the present invention.

FIG. 19 shows a hearing aid switch circuit 1900. Circuit 1900 is similar to circuit 1600 described above with like elements being identified by reference numerals having the same two least significant digits and the two larger value digits being changed from 16 to 19. For example, the supply voltage is designated as 1601 in FIG. 16 and 1901 in FIG. 19. Switching circuit 1900 includes an electrical connection from the output of inverter 1907 to the signal processor 1922. Consequently, inverter 1907 outputs a low signal to first input 1909, second inverter 1911 and signal processor 1922 with the magnetic field sensing switch 1905 being open. Inverter 1907 outputs a high signal to first input 1909, second inverter 1911 and signal processor 1922 with the magnetic field sensing switch 1905 being closed. Thus, the signal processor 1922 receives a hearing aid state signal from the inverter 1907. In an embodiment, when the state signal is low, then the signal processor 1907 is adapted to optimize the hearing aid signal processing for a second (microphone) input from second input (microphone) 1913. Second input (microphone) 1913 is in an active state as it has received a high or on signal from second inverter 1911. The signal processing circuit 1922, in an embodiment, optimizes the signal processing by selecting stored parameters, which are optimized for second input signal processing, from a memory. In an embodiment, the memory is an integrated circuit memory that is part of the signal processor 1922. When the state signal is high, then the signal processor 1922 is adapted to optimize the hearing aid signal processing for a first input from first input (telecoil induction)1909. First input 1909 is in an active state as it has received a high or on signal from first inverter 1907. The signal processing circuit 1922, in an embodiment, optimizes the signal processing by selecting stored parameters, which are optimized for first input (induction) signal processing, from the memory. Other stored parameters in the memory of signal processor 1922 include automatic gain control, frequency response, and noise reduction for respective embodiments of the present disclosure.

Figure 20:
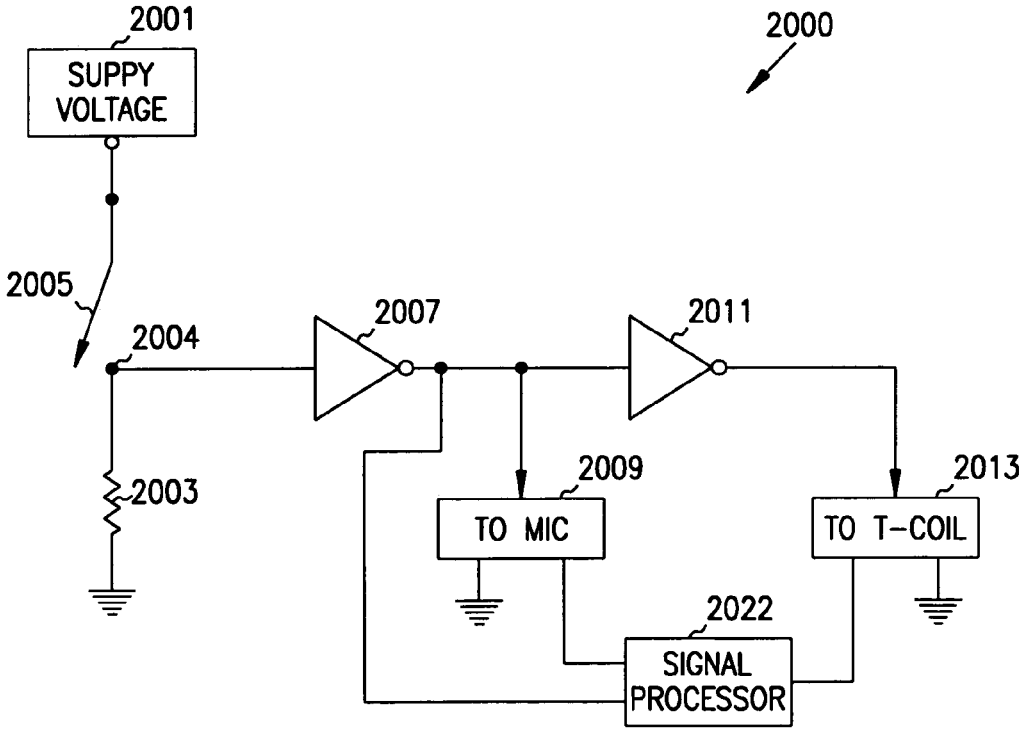
FIG. 20 is a diagram of a switching circuit according to an embodiment of the present invention.

FIG. 20 shows a hearing aid switch circuit 2000. Circuit 2000 is similar to circuit 1700 described above with like elements being identified by reference numerals having the same two least significant digits and the two larger value digits being changed from 17 to 20. For example, the supply voltage is designated as 1701 in FIG. 17 and 2001 in FIG. 20. Switching circuit 2000 includes an electrical connection from the output of first inverter 2007 to the signal processor 2022. Consequently, inverter 2007 outputs a high signal to first input 2009, second inverter 2011 and signal processor 2022 with the magnetic field sensing switch 2005 being open. Inverter 2007 outputs a low signal to first input 2009, second inverter 2011 and signal processor 2022 with the magnetic field sensing switch 2005 being closed. Thus, signal processor 2022 receives a hearing aid state signal from the inverter 2007. In an embodiment, when the state signal is high, then the signal processor 2022 is adapted to optimize the hearing aid signal processing for a first input signal from first input (microphone) 2009. First input 2009 is in an active state as it has received a high or on signal from first inverter 2007. The signal processing circuit 2022, in an embodiment, optimizes the signal processing by selecting stored parameters, which are optimized for microphone signal processing, from a memory. In an embodiment, the memory is an integrated circuit memory that is part of the signal processor 2022. When the state signal is low or off, then the signal processor 2022 is adapted to optimize the hearing aid signal processing for a second input signal from second input (telecoil) 2013. Second input 2013 is in an active state as it has received a high or on signal from second inverter 2011. The signal processing circuit 2022, in an embodiment, optimizes the signal processing by selecting stored parameters, which are optimized for second signal (induction) processing, from the memory. Other stored parameters in the memory of signal processor 2022 include automatic gain control, frequency response, and noise reduction for respective embodiments of the present disclosure.

Figure 21:
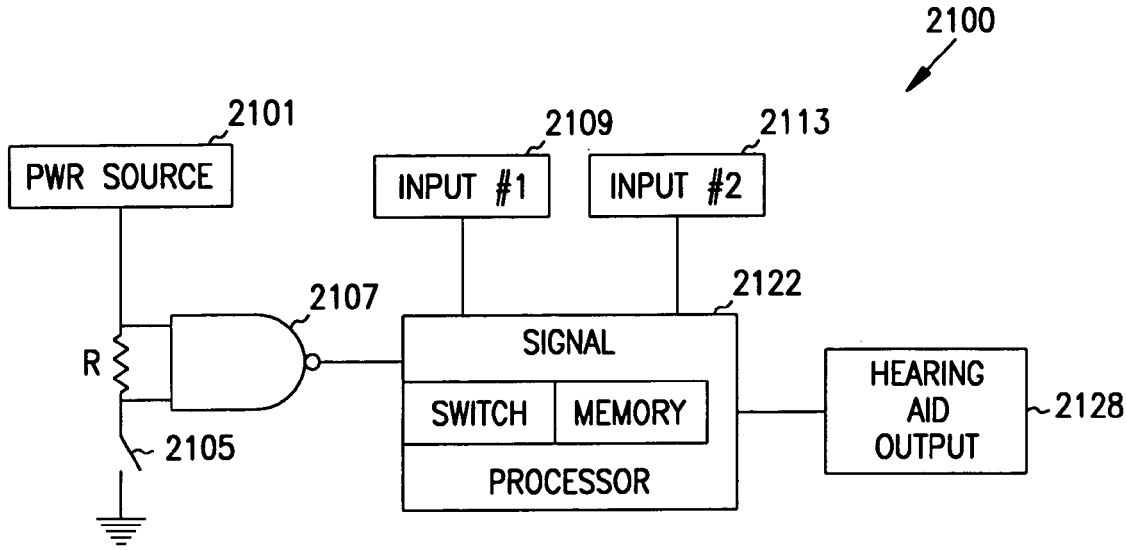
FIG. 21 is a diagram of a switching circuit according to an embodiment of the present invention.

FIG. 21 shows a hearing aid switch circuit 2100. Circuit 2100 includes elements that are substantially similar to elements described above. Like elements are identified by reference numerals having the same two least significant digits and the two larger value digits being changed 21. For example, the supply voltage is designated as 1601 in FIG. 16, 1701 in FIG. 17 and 2101 in FIG. 21. Switching circuit 2100 includes a selection circuit that selects signal processing parameters. Selection circuit includes a logic gate 2107. In the illustrated embodiment, the logic gate 2107 is a NAND gate. A first input of the NAND gate 2107 is connected to the power source 2101. Thus, this input to the NAND gate is always high. A second input of the NAND gate 2107 is connected to the power source 2201 through a resistor and to a first terminal of magnetic field sensing switch 2105. Consequently, the state of the switch 2105 determines the output of the NAND gate 2107 during operation of the hearing aid switch 2100. Operation of hearing aid switch 2100 is defined as when the switch is powered. During the off or non-operational state of the hearing aid switch circuit 2100, the supply voltage 2101 is turned off and the NAND gate 2107 will always produce a low output to conserve power, which is a consideration in designing hearing aid circuits. The switch 2105 is normally open. Thus, both inputs to the NAND gate 2107 are high and its output signal is high. The output of NAND gate 2107 is connected to signal processor 2122. Signal processor 2122 includes a switch that upon the change of state of the NAND gate output signal changes a parameter setting in signal processor 2122. In an embodiment, when the magnetic field sensing switch 2105 senses a magnetic field, switch 2105 closes. The second input to NAND gate 2107 goes low and NAND gate output goes low. This triggers the switch of signal processor 2122 to change parameter settings. In an embodiment, signal processor only changes its parameter settings when the signal from NAND gate 2107 shifts from high to low. In an embodiment, the parameter settings include parameters stored in a memory of signal processor 2122. In an embodiment, a first parameter setting is adapted to process input from first input 2109. A second parameter setting is adapted to process input from second input 2113. In an embodiment, the first parameter setting is selected with the output signal from NAND gate 2107 being high. The second parameter setting is selected with the output signal from NAND gate 2107 being low. Accordingly, the switching circuit 2100 can select parameters that correspond to the type of input, e.g., microphone or induction inputs or directional and omni-directional inputs. The hearing aid thus more accurately produces sound for the hearing aid wearer. In an embodiment, the switch in signal processor 2122 is adapted to progress from one set of stored parameters to the next each time the signal from NAND gate 2107 goes low.

Figure 22:
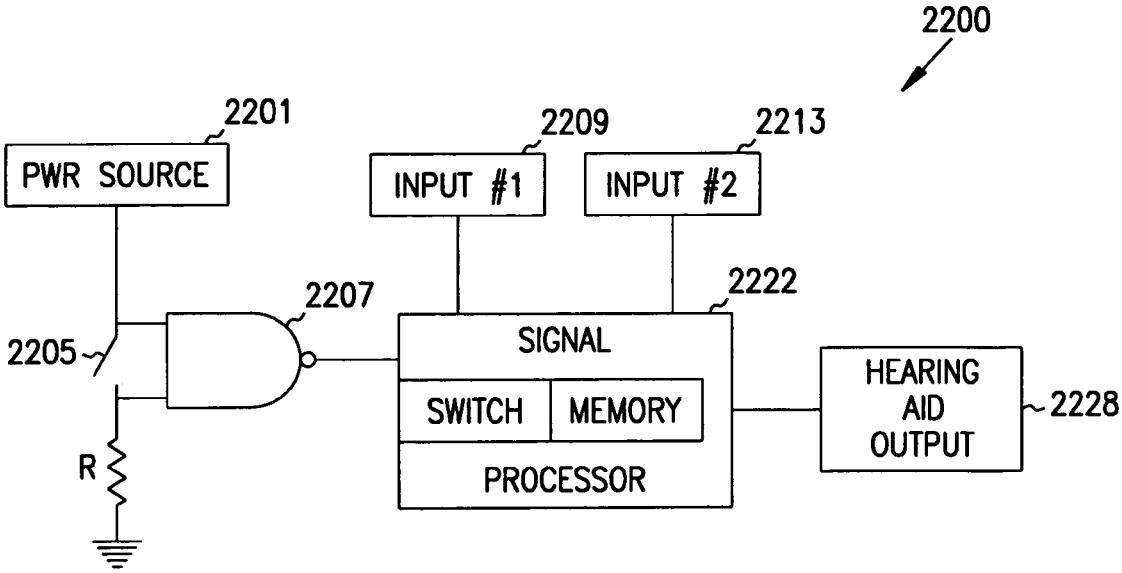
FIG. 22 is a diagram of a switching circuit according to an embodiment of the present invention.

FIG. 22 shows a hearing aid switch circuit 2200. Circuit 2200 includes elements that are substantially similar to elements described above. Like elements are identified by reference numerals having the same two least significant digits and the two larger value digits being changed 22. For example, the supply voltage is designated as 2101 in FIG. 21 is 2201 in FIG. 22. Switching circuit 2200 includes a selection circuit that is adapted to select parameters for signal processing. The selection circuit includes a logic gate 2207 having its output connected to signal processor 2222. In the illustrated embodiment, the logic gate 2207 is a NAND gate. A first input of the NAND gate 2207 is connected to the power source 2201. Thus, this input to the NAND gate is always high. A second input of the NAND gate 2207 is connected to the power source 2201 through a magnetic field sensing switch 2105. The second input of NAND gate 2207 is also connected to ground through a resistor R. Consequently, the state of the switch 2205 determines the output of the NAND gate 2207 during operation of the hearing aid switch 2200. Operation of hearing aid switch 2200 is defined as when the switch is powered. During the off or non-operational state of the hearing aid switch circuit 2200, the supply voltage 2201 is turned off and the NAND gate 2207 will always produce a low output to conserve power, which is a consideration in designing hearing aid circuits. Switch 2205 is normally open. Thus, the first input to the NAND gate 2207 is high and the second input to NAND gate 2207 is low. Thus, the NAND gate output signal is low. Signal processor 2222 includes a switch that upon the change of state of the NAND gate output signal changes a parameter setting in signal processor 2222. In an embodiment, when the magnetic field sensing switch 2205 senses a magnetic field, switch 2205 closes. The second input to NAND gate 2207 goes high and NAND gate output goes high. This triggers the switch of signal processor 2222 to change parameter settings. In an embodiment, signal processor only changes its parameter settings when the signal from NAND gate 2107 shifts from low to high. In an embodiment, the parameter settings include parameters stored in a memory of signal processor 2222. In an embodiment, a first parameter setting is adapted to process input from first input 2209. A second parameter setting is adapted to process input from second input 2213. In an embodiment, the first parameter setting is selected with the output signal from NAND gate 2207 being low. The second parameter setting is selected with the output signal from NAND gate 2207 being high. Accordingly, the switching circuit 2200 can select parameters that correspond to the type of input, e.g., microphone or induction inputs. The hearing aid thus more accurately produces sound for the hearing aid wearer.

It will be appreciated that the selection of parameters for specific inputs can be combined with the FIGS. 2-18 embodiments. For example, the magnetic field sensor changing state not only switches the input but also generates a signal, for example, through logic circuit elements, that triggers the signal processing circuit to change its operational parameters to match the type of input.

Possible applications of the technology include, but are not limited to, hearing aids. Various types of magnetic field sensors are described herein for use in hearing aids. One type is a mechanical reed switch. Another type is a solid state magnetic responsive sensor. Another type is a MEMS switch. Another type is a GMR sensor. Another type is a core saturation circuit. Another type is anisotropic magneto resistive circuit. Another type is magnetic field effect transistor. It is desirable to incorporate solid state devices into hearing aids as solid state devices typically are smaller, consume less power, produce less heat then discrete components. Further the solid state switching devices can sense and react to a varying magnetic field at a sufficient speed so that the magnetic field is used for supplying programming signals to the hearing aid.

Those skilled in the art will readily recognize how to realize different embodiments using the novel features of the present invention. Several other embodiments, applications and realizations are possible without departing from the present invention. Consequently, the embodiment described herein is not intended in an exclusive or limiting sense, and that scope of the invention is as claimed in the following claims and their equivalents.

What is claimed is:

1. A hearing aid, comprising:

an input system;

an output system;

a programmable, signal processing system electrically connecting the input system to the output system;

a magnetic field sensor; and a selection circuit connected to the magnetic field sensor, the selection circuit structured to control at least one of the input system, output system and the signal processing system, wherein the selection circuit and the magnetic field sensor are configured to determine three different magnetic field strengths such that each one of the three different magnetic field strengths corresponds to a different one of the input system, the output system, and the signal processing system and to select one of the input system, output system and the signal processing system based on a determination that a magnetic field sensed at the magnetic field sensor has one of the three different magnetic field strengths, the three different magnetic field strengths being in a range greater than or equal to a minimum magnetic field strength detectable by the magnetic field sensor.

2. The hearing aid of claim 1, wherein the selection circuit is adapted to receive an electrical signal from the magnetic sensor and supply a programming signal to the signal processing circuit.

3. The hearing aid of claim 1, wherein the magnetic field sensor is a full bridge circuit.

4. The hearing aid of claim 1, wherein the magnetic field sensor is adapted to receive a pulsed power supply.

5. The hearing aid of claim 1, wherein the selection circuit is connected to the input system and sends a control signal to the input system based on a signal received from the magnetic field sensor.

6. The hearing aid of claim 5, wherein the input system includes a first input and a second input, and the input system activates one of the first input and the second input based on the control signal.

7. The hearing aid of claim 6, wherein the first input is an omni-directional microphone, and wherein the second input is a telecoil.

8. The hearing aid of claim 5, wherein the input system includes an input signal filter and the input system selectively bypasses the filter based on the control signal.

9. The hearing aid of claim 6, wherein the first input is an omni-directional microphone, and wherein the second input is a directional microphone.

10. The hearing aid of claim 1, wherein the magnetic field sensor includes a threshold circuit that blocks signals below a threshold value.

11. The hearing aid of claim 10, wherein the threshold circuit includes an output electrically connected to the selection circuit.

12. The hearing aid of claim 10, wherein the magnetic field sensor includes a threshold control that sets the threshold value.

13. The hearing aid of claim 10, wherein the magnetic field sensor includes an amplifier and a low pass filter before the threshold circuit.

14. The hearing aid of claim 1, wherein the selection circuit is connected to the signal processing circuit and sends a control signal and a programming signal to the signal processing circuit based on a signal received from the magnetic field sensor.

15. The hearing aid of claim 14, wherein the signal processing circuit is adapted to be programmed by the programming signal.

16. The hearing aid of claim 1, wherein the selection circuit is connected to the output system and sends a control signal to the output system based on a signal received from the magnetic field sensor.

17. The hearing aid of claim 16, wherein the output system includes an output signal filter and the output system bypasses the filter based on the control signal.

18. The hearing aid of claim 1, wherein the selection circuit is adapted to receive an electrical signal from the magnetic sensor and select operational parameters for the signal processing circuit.

19. The hearing aid of claim 18, wherein the selection circuit includes a logic element.

20. The hearing aid of claim 18, wherein the selection circuit includes a NAND gate having a first input connected to a power supply and a second input connected a magnetic field sensing switch.

21. The hearing aid of claim 1, wherein one of the three different magnetic field strengths is the minimum magnetic field strength detectable by the magnetic field sensor.

22. The hearing aid of claim 1, wherein one of the three different magnetic field strengths is a variance from one of the other two different magnetic field strengths.

23. The hearing aid of claim 1, wherein the selection circuit and the magnetic field sensor are configured to determine a fourth magnetic field strength to automatically turn off the hearing aid.

24. A hearing aid, comprising:

an input system;

an output system;

a programmable, signal processing circuit electrically connecting the input system to the output system;

a magnetic field sensor; and a selection circuit connected to the magnetic sensor and at least one of the input system, output system and the signal processing system, the selection circuit being adapted to control the at least one of the input system, output system and the signal processing system, wherein the input system includes a first input and a second input, and the input system activates one of the first input and the second input based on the control signal, wherein the first input is an omni-directional microphone, and wherein the second input is a directional microphone.

25. A hearing aid, comprising:

an input system;

an output system;

a programmable, signal processing circuit electrically connecting the input system to the output system;

a magnetic field sensor; and a selection circuit connected to the magnetic sensor and at least one of the input system, output system and the signal processing system, the selection circuit being adapted to control the at least one of the input system, output system and the signal processing system, wherein the magnetic field sensor includes a threshold circuit that blocks signals below a threshold value, wherein the threshold circuit includes an output electrically connected to the selection circuit.

26. A hearing aid, comprising:

an input system;

an output system;

a programmable, signal processing circuit electrically connecting the input system to the output system;

a magnetic field sensor; and a selection circuit connected to the magnetic sensor and at least one of the input system, output system and the signal processing system, the selection circuit being adapted to control the at least one of the input system, output system and the signal processing system, wherein the magnetic field sensor includes a threshold circuit that blocks signals below a threshold value, wherein the magnetic field sensor includes a threshold control that sets the threshold value.

27. A hearing aid, comprising:

an input system;

an output system;

a programmable, signal processing circuit electrically connecting the input system to the output system;

a magnetic field sensor; and a selection circuit connected to the magnetic sensor and at least one of the input system, output system and the signal processing system, the selection circuit being adapted to control the at least one of the input system, output system and the signal processing system, wherein the magnetic field sensor includes a threshold circuit that blocks signals below a threshold value, wherein the magnetic field sensor includes an amplifier and a low pass filter before the threshold circuit.

28. A hearing aid, comprising:

an input system;

an output system;

a programmable, signal processing circuit electrically connecting the input system to the output system;

a magnetic field sensor; and a selection circuit connected to the magnetic sensor and at least one of the input system, output system and the signal processing system, the selection circuit being adapted to control the at least one of the input system, output system and the signal processing system, wherein the selection circuit is connected to the output system and sends a control signal to the output system based on a signal received from the magnetic field sensor, wherein the output system includes an output signal filter and the output system bypasses the filter based on the control signal.

29. A hearing aid, comprising:

an input system;

an output system;

a programmable, signal processing circuit electrically connecting the input system to the output system;

a magnetic field sensor; and a selection circuit connected to the magnetic sensor and at least one of the input system, output system and the signal processing system, the selection circuit being adapted to control the at least one of the input system, output system and the signal processing system, wherein the selection circuit is adapted to receive an electrical signal from the magnetic sensor and select operational parameters for the signal processing circuit, wherein the selection circuit includes a NAND gate having a first input connected to a power supply and a second input connected a magnetic field sensing switch.

* * * * *

UNITED STATES PATENT AND TRADEMARK OFFICE

CERTIFICATE OF CORRECTION

PATENT NO. : 7,369,671 B2
APPLICATION NO. : 10/244295
DATED : May 6, 2008
INVENTOR(S) : Sacha et al.

It is certified that error appears in the above-identified patent and that said Letters Patent is hereby corrected as shown below:

Title Pg, Item (57), under "Abstract", after "with a" delete "a".

In column 1, line 9, delete "HEARTNG" and insert -- HEARING --, therefor.

In column 10, line 22, delete "firther" and insert -- further --, therefor.

In column 16, line 29, delete "non-groung" and insert -- non-ground --, therefor.

In column 17, line 4, delete "digit" and insert -- digits --, therefor.

In column 17, line 61, after "off" insert -- . --.

In column 22, line 42, in Claim 20, after "connected" insert -- to --.

In column 24, line 40, in Claim 29, after "connected" insert -- to --.

Signed and Sealed this

Twelfth Day of August, 2008

JON W. DUDAS
*Director of the United States Patent and Trademark Office*